US011584582B2

(12) United States Patent
Kelly et al.

(10) Patent No.: US 11,584,582 B2
(45) Date of Patent: Feb. 21, 2023

(54) CONVERTIBLE BEVERAGE CONTAINER PACKAGE HAVING AN INTEGRATED COOLER COMPARTMENT

(71) Applicant: COORS BREWING COMPANY, Denver, CO (US)

(72) Inventors: Jason M. Kelly, Arvada, CO (US); Herbert B. Smith, Mississauga (CA); Charles Ho Fung, Berlin, WI (US); Darin G. McKnight, II, Pewaukee, WI (US); Eric A. Haas, Denver, CO (US)

(73) Assignee: COORS BREWING COMPANY, Denver, CO (US)

( * ) Notice: Subject to any disclaimer, the term of this patent is extended or adjusted under 35 U.S.C. 154(b) by 278 days.

(21) Appl. No.: 16/632,760

(22) PCT Filed: Jul. 20, 2018

(86) PCT No.: PCT/US2018/042985
§ 371 (c)(1),
(2) Date: Jan. 21, 2020

(87) PCT Pub. No.: WO2019/018708
PCT Pub. Date: Jan. 24, 2019

(65) Prior Publication Data

US 2020/0156847 A1 May 21, 2020

Related U.S. Application Data

(60) Provisional application No. 62/535,562, filed on Jul. 21, 2017.

(51) Int. Cl.
*B65D 81/18* (2006.01)
*B65D 30/20* (2006.01)
(Continued)

(52) U.S. Cl.
CPC ..... *B65D 81/18* (2013.01); *B65D 31/10* (2013.01); *B65D 33/08* (2013.01); *B65D 65/466* (2013.01); *B65D 77/0406* (2013.01)

(58) Field of Classification Search
CPC ..... B65D 30/02; B65D 31/10; B65D 33/06; B65D 33/08; B65D 65/46; B65D 65/466;
(Continued)

(56) References Cited

U.S. PATENT DOCUMENTS 4,574,978 A 3/1986 Hodges
4,738,363 A 4/1988 Hudson
(Continued)

FOREIGN PATENT DOCUMENTS

WO WO 02/18228 3/2002

OTHER PUBLICATIONS

International Search Report and Written Opinion for International (PCT) Patent Application No. PCT/US2018/42985, dated Oct. 2, 2018. 15 pages.
(Continued)

*Primary Examiner* — Bryon P Gehman
(74) *Attorney, Agent, or Firm* — Sheridan Ross. P.C.

(57) ABSTRACT

A convertible beverage container package having an integrated cooler compartment is provided that is sized to contain a number of cans in a box shape during transit, storage, and sale and which can be converted to a portable cooler configured to receive ice for cooling the cans contained therein. The shape of the convertible beverage container package allows a compact package for storage and transport, which can be selectively expanded to receive ice. In some cases, the received ice may surround two or more sides of the beverage cans. In one case, the shape of the
(Continued)

convertible beverage container package may direct ice inside the package to contact the canned beverages on at least three sides.

20 Claims, 15 Drawing Sheets

(51) Int. Cl.
*B65D 33/08* (2006.01)
*B65D 65/46* (2006.01)
*B65D 77/04* (2006.01)

(58) Field of Classification Search
CPC .... B65D 77/04; B65D 77/0406; B65D 81/18; B65D 30/20; F25D 3/06; F25D 25/00; F25D 31/00; F25D 31/007
See application file for complete search history.

(56) References Cited

U.S. PATENT DOCUMENTS 4,779,998 A * 10/1988 Wischusen, III ..... B65D 31/06 383/104
5,582,343 A * 12/1996 Dalvey ..... B65D 5/42 229/101
5,788,378 A 8/1998 Thomas
8,033,727 B2 * 10/2011 Gattino ..... F25D 3/08 383/122
2004/0008908 A1 1/2004 Shepard
2007/0036473 A1 2/2007 Nagata et al.
2010/0329590 A1 12/2010 Minkler
2012/0014624 A1 * 1/2012 Jones ..... B65D 33/2508 383/110
2013/0026170 A1 1/2013 Zefras et al.
2013/0142454 A1 6/2013 Simmonite
2014/0212068 A1 7/2014 Yu et al.
2016/0016695 A1 1/2016 Pereira et al.

OTHER PUBLICATIONS

International Preliminary Report on Patentability for International (PCT) Application No. PCT/US2018/42985, dated Jan. 30, 2020, 12 pages.
Official Action for Canada Patent Application No. 3070680, dated Apr. 7, 2021, 4 pages.
Official Action for Canada Patent Application No. 3070680, dated Dec. 14, 2021, 4 pages.
International Search Report and Written Opinion for International (PCT) Patent Application No. PCT/US2018/042985, dated Oct. 2, 2018.

* cited by examiner

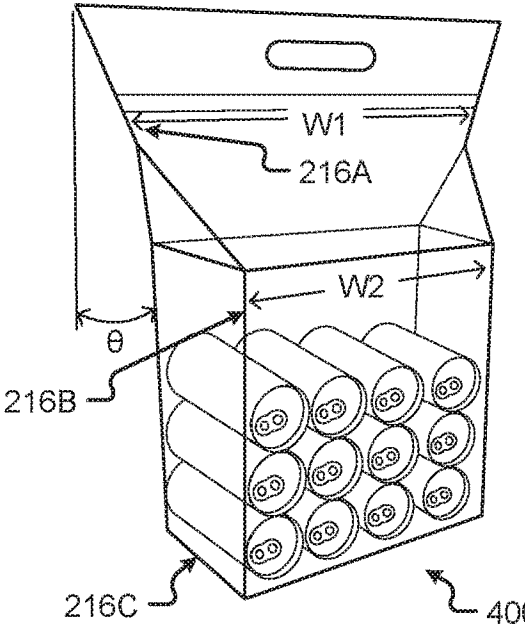
Fig. 4A
Fig. 4B
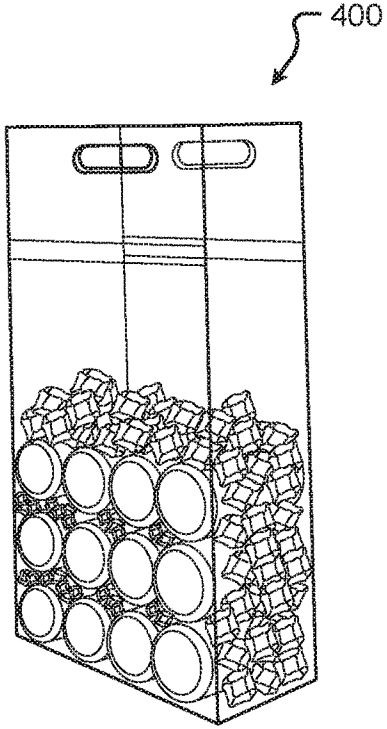
Fig. 4C

CONVERTIBLE BEVERAGE CONTAINER PACKAGE HAVING AN INTEGRATED COOLER COMPARTMENT

CROSS REFERENCE TO RELATED APPLICATIONS

This application is a national stage application under 35 U.S.C. 371 and claims the benefit of PCT Application No. PCT/US2018/042985 having an international filing date of 20 Jul. 2018, which designated the United States, which PCT application claimed the benefit of and priority, under 35 U.S.C. § 119(e), to U.S. Provisional Application Ser. No. 62/535,562, filed Jul. 21, 2017, entitled "Convertible Beverage Container Package having an Integrated Cooler Compartment." The entire disclosures of the applications listed above are hereby incorporated herein by reference, in their entirety, for all that they teach and for all purposes.

FIELD

The present disclosure is generally directed to beverage packaging, in particular, toward multipurpose beverage packaging for canned beverages.

BACKGROUND

Historically, canned beverages have been packaged together in cardboard boxes or plastic rings for easy transport, storage, and sale. Both the cardboard box and plastic ring packages may include relieved areas where a person can carry the package and the beverages contained therein. While cardboard boxes allow a greater number of cans to be packaged in a single portable container, and may include between approximately six and twenty-four cans, the plastic rings are typically only used to package groups of four to six cans together.

A benefit of the cardboard box packaging includes providing a container to hold the canned beverages together in a refrigerated environment while providing a number of surfaces for graphics, branding, and/or marketing purposes. As most plastic rings are made from a minimal amount of material including an area that is stretched over only the formed upper portion of a can, the plastic rings do not generally include advertising, branding, or graphics. In this case, the cans must include all of the graphics for branding and/or advertising.

Although newer cardboard box and plastic ring designs include a number of environmentally friendly features, including recycled materials and high biodegradability, each package is specifically designed to hold a group of cans together for transport and a particular storage. For instance, the cardboard box may be stored in a refrigerated dry environment to keep the canned beverages cool but cannot be stored in a wet environment (e.g., a cooler, ice bucket, ice bath, etc.) without compromising the integrity of the packaging. On the other hand, the plastic ring package may be submerged in a dry or a wet environment (e.g., a cooler, ice bucket, ice bath, etc.) to keep the canned beverages cool but offers a limited number of cans which can be grouped together in the package. Further, each style of packaging requires a separate cooling device or apparatus to keep the canned beverages cool.

BRIEF DESCRIPTION OF THE DRAWINGS

FIG. 4A shows a perspective view of a convertible beverage container package having an integrated cooler compartment in accordance with embodiments of the present disclosure;

FIG. 4B shows a perspective view of the convertible beverage container package having the integrated cooler compartment of FIG. 4A in an unfolded state;

FIG. 4C shows a perspective view of the convertible beverage container package having the integrated cooler compartment of FIG. 4B filled to a level with ice;

Figure 1A:
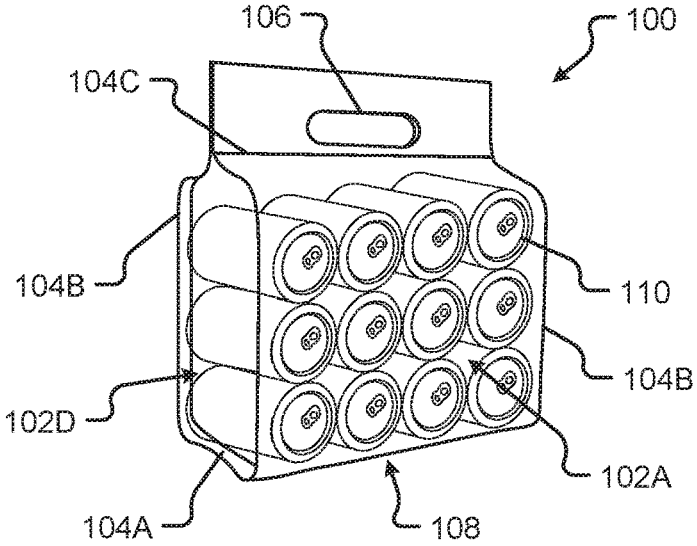
FIG. 1A shows a perspective view of a convertible beverage container package having an integrated cooler compartment in accordance with embodiments of the present disclosure.

In the appended figures, similar components and/or features may have the same reference label. Further, various components of the same type may be distinguished by following the reference label by a letter that distinguishes among the similar components. If only the first reference label is used in the specification, the description is applicable to any one of the similar components having the same first reference label irrespective of the second reference label.

DETAILED DESCRIPTION

Copyright and Legal Notices

A portion of the disclosure of this patent document contains material which is subject to copyright protection. The copyright owner has no objection to the facsimile reproduction by anyone of the patent document or the patent disclosure, as it appears in the Patent and Trademark Office patent files or records, but otherwise reserves all copyrights whatsoever.

It is with respect to the above issues and other problems that the embodiments presented herein were contemplated. Embodiments of the present disclosure will be described in connection with a convertible beverage container package having the integrated cooler compartment. In general, embodiments of the present disclosure provide a canned beverage bag assembly that is configured to contain a number of cans in a box shape during transit, storage, and sale and which can be converted to a portable cooler configured to receive ice for cooling the cans contained therein. The shape of the convertible beverage container package allows a compact package for storage and transport, which can be selectively expanded to receive ice. In some embodiments, the received ice may surround two or more sides of the beverage cans. In one embodiment, the shape of the convertible beverage container package may direct ice to completely surround the canned beverages on at least three sides.

In some embodiments, the portable and convertible beverage container package has a number of leak-proof seals configured to support the weight of filled canned beverages, ice, and even water contained in an interior volume of the package. The convertible beverage container package may be manufactured from a flexible plastic configured to expand and accommodate the shape of the cans and ice. The plastic may be made from recycled material and may be recyclable and/or biodegradable. In some cases, the plastic may comprise one or more thermal insulative layers providing a thermal barrier between the interior volume of the package and an environment outside of the package. In some embodiments, the plastic material of the package may be sufficiently strong such that the package can be reused for the same intended use (e.g., carrying and/or cooling canned beverages, bottles, containers, etc.) or other uses (e.g., carrying bottles, food, objects, etc.)

The portable and convertible beverage container package may be configured to hold any number of canned beverages. For instance, the portable and convertible beverage container package, whether in a packaging state or converted state, may be configured to hold two, four, six, eight, nine, twelve, eighteen, twenty-four, etc., and/or any other number of canned beverages. Additionally or alternatively, the portable and convertible beverage container package may hold bottles, jars, or any other type of beverage container and, as such, is not limited to holding canned beverages. For the sake of simplicity, the embodiments disclosed herein are described as using canned beverage containers.

Figure 1B:
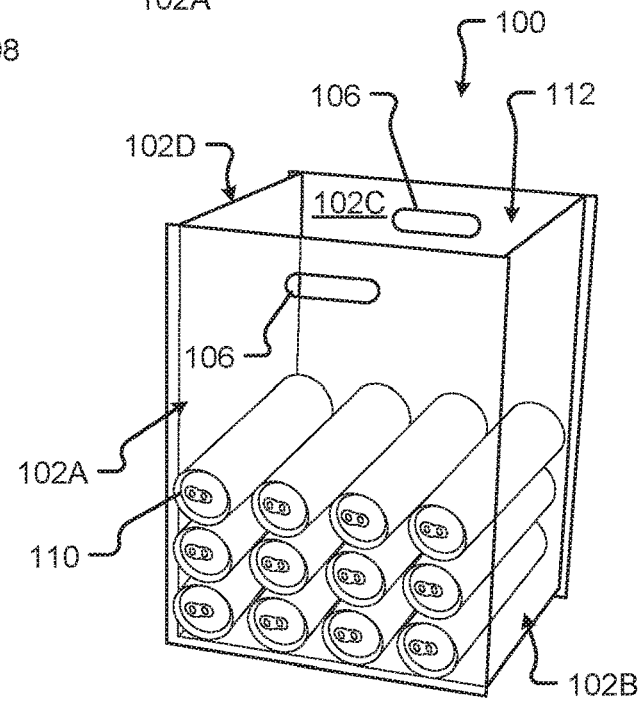
FIG. 1B shows a perspective view of the convertible beverage container package having the integrated cooler compartment of FIG. 1A in an opened state.
Figure 1C:
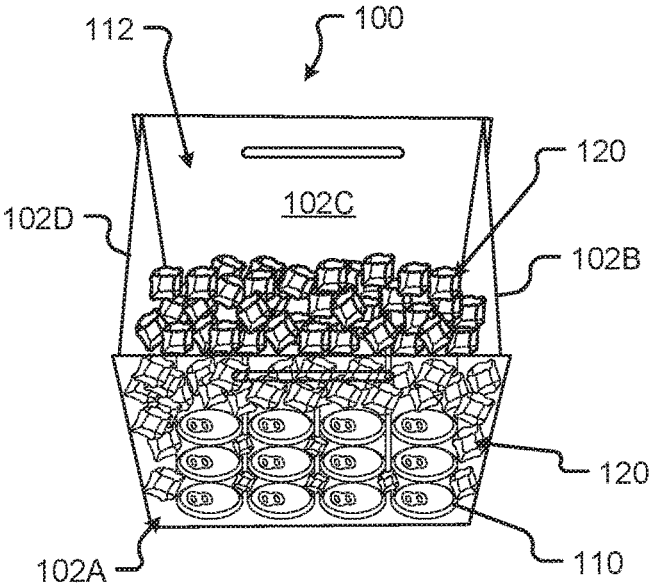
FIG. 1C shows a top perspective view of the convertible beverage container package having the integrated cooler compartment of FIG. 1B filled to a level with ice.

FIGS. 1A-1C show various perspective views of a convertible beverage container package having an integrated cooler compartment ("package") 100 in accordance with embodiments of the present disclosure. The package 100 may comprise a plastic or waterproof bag including a front wall 102A, side walls 102B, 102D, and a rear wall 102C. In some embodiments, the walls 102A-D may be manufactured from a single sheet of plastic material. In one embodiment one or more of the walls 102A-D may be manufactured from a separate piece of plastic material than another of the one or more of the walls 102A-D and then joined together. In any event, the package 100 may be manufactured via one or more converting steps including, but in no way limited to, laminating, heat-sealing, coating, melting, folding, and/or the like. The package 100 may include a number of edges or seams 104A-C that may include, but are in no way limited to, heat-sealed edges, reinforced edges, folded edges, overlapped and staked edges, or other joined material seams.

In some embodiments, and as shown in FIG. 1A, the walls 102A-D of the package 100 may be foldable such that a container for a plurality of canned beverages is formed. In a folded state, the package 100 may include a substantially cuboid or rectangular cuboid shape. A carrying handle 106 may be disposed on at least one side or portion of the package 100. In some embodiments, the carrying handle 106 may be arranged on a web or portion of the package 100 that can be selective extended from the folded package 100. Additionally or alternatively, the substantially cuboid or rectangular cuboid shape of the package 100 may include a substantially rectangular base 108 upon which the package 100 may be supported. The base 108 may be formed by folding, and/or gusseting, one or more of the walls 102A-D of the package 100 providing a substantially flat or planar resting surface for the package 100.

FIGS. 1B and 1C show perspective views of the package 100 in an opened state in accordance with embodiments of the present disclosure. Among other things, the package 100 of FIGS. 1B and 1C is unfolded and opened at an upper portion of the package 100 to reveal a compartment, or interior volume, 112 that is sized to receive a plurality of canned beverages 110 and ice 120. It is an aspect of the present disclosure that the package 100 is shaped and sized such that the ice 120 is directed to cool multiple sides of the canned beverages 110 contained therein. As shown in FIG. 1C, the ice 120 may be disposed on a top of the canned beverages 110, in between the front wall 102A and the canned beverages 110, and in between the side walls 102B, 102D, and the canned beverages 110.

As illustrated in FIGS. 1B and 1C, the handle 106 is arranged as a cutout in an upper portion of the front and rear walls 102A, 102C. The cutout of the handle 106 may be sized to receive one or more fingers, or a hand, of a person. In some cases, the cutout of the handle 106 may include one or more reinforced edges, folds, and/or additional layers of material. Additional layers of material may be fused, or otherwise attached, to the package 100 adjacent to the handle 106. In any event, the additional layers of material may provide a comfort feature (e.g., while carrying, etc.), additional strength, tear resistance, etc., and/or an interconnection feature (e.g., providing an interconnection from the handle 106 in the front wall 102A to the handle 106 in the rear wall 102C).

Figure 2A:
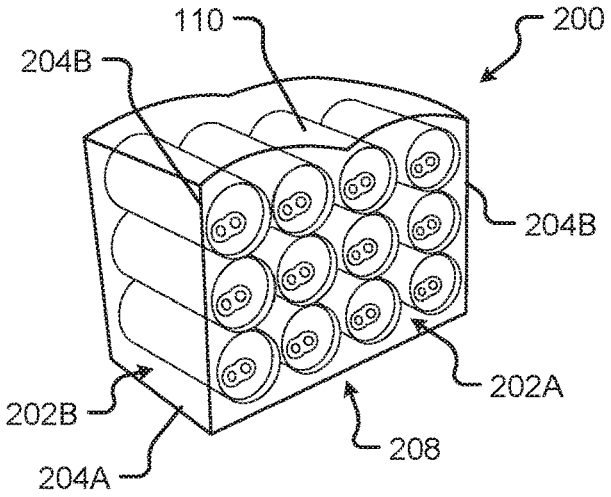
FIG. 2A shows a perspective view of a convertible beverage container package having an integrated cooler compartment in accordance with embodiments of the present disclosure.
Figure 2B:
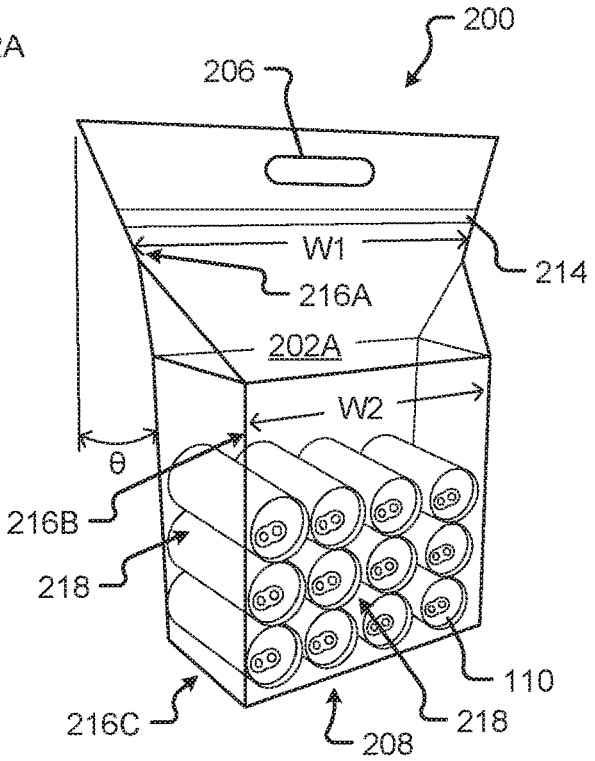
FIG. 2B shows a perspective view of the convertible beverage container package having the integrated cooler compartment of FIG. 2A in an unfolded state.
Figure 2C:
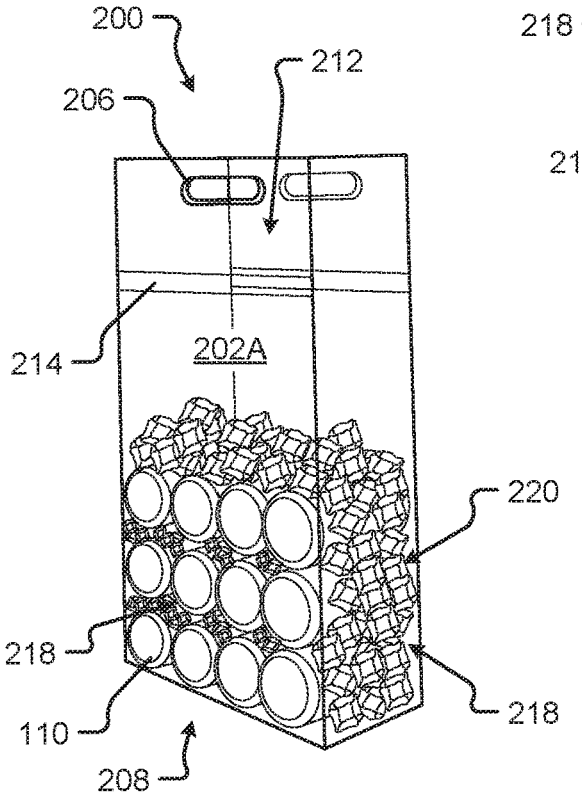
FIG. 2C shows a perspective view of the convertible beverage container package having the integrated cooler compartment of FIG. 2B filled to a level with ice.

FIGS. 2A-2C show various perspective views of a convertible beverage container package having an integrated cooler compartment, or package, 200 in accordance with embodiments of the present disclosure. The material, structure, and/or manufacture of the package 200 may be similar, if not identical, to the material, structure, and/or manufacture of the package 100 described in conjunction with FIGS. 1A-1C, and as such, any description of the same may equally apply to the package 200 of FIGS. 2A-2C and/or any other package 300, 400, 500, 600, 700 described in conjunction with FIGS. 3A-7C, and vice versa.

As illustrated in FIG. 2A, the package 200 include a folded state such that the package 200 is substantially cuboid or rectangular cuboid in shape. In some embodiments, a carrying handle 206 may be exposed from the package 200 when a portion of the package 200 is unfolded. The carrying handle 206 may be disposed in one or more walls 202A, 202B of the package 200. In some embodiments, the carrying handle 206 may be arranged on a web or portion of the package 200 that can be selective extended from the folded package 200 without requiring the entirety of the package 200 to be unfolded. Additionally or alternatively, the substantially cuboid or rectangular cuboid shape of the package 200 may include a substantially rectangular base 208 upon which the package 200 may be supported. The base 208 may be formed by folding, and/or gusseting, one or more of the walls 202A-B of the package 200 providing a substantially flat or planar resting surface for the package 200.

Referring now to FIG. 2B, a perspective view of the package 200 in an unfolded state is shown in accordance with embodiments of the present disclosure. In some embodiments, the package 200 may include a tapered shape defining an interior volume 212 of the package 200. Among other things, the tapered shape may direct ice 220 along multiple sides of the canned beverages 110 contained therein. Additionally or alternatively, the tapered shape of the package 200 may provide a number of cooling volumes 218 disposed around a number of sides of the canned beverages 110 such that ice 220 inserted into the package is held in the interior volume 212 and the cooling volumes 218 of the package 200.

As illustrated in FIGS. 2B and 2C, the handle 206 may be integrated with the package 200 (e.g., arranged as a cutout, perforation, or other relieved portion of the package 200). In some embodiments, the handle 206 may be disposed in an uppermost portion of the front and rear walls of the package 200. The handle 206 may be sized to receive one or more fingers, or a hand, of a person. In some cases, the handle 206 may include one or more reinforced edges, folds, and/or additional layers of material. Additional layers of material may be fused, or otherwise attached, to the package 200 adjacent to the handle 206. In any event, the additional layers of material may provide a comfort feature (e.g., while carrying, etc.), additional strength, tear resistance, etc., and/or an interconnection feature (e.g., providing an interconnection from the handle 206 in the front wall 202A to a handle 206 in the opposite wall of the package 200).

In some embodiments, the package 200 may include a closure mechanism 214 that is integrated with a portion of the package 200. For instance, the package 100 may include a tongue-and-groove closure mechanism 214 disposed at an upper portion 216A of the package 200. As another example, the closure mechanism 214 may include a protrusion feature on a first wall 202A and a complementary receiving feature on a wall opposite the first wall 202A. In any event, the closure mechanism 214 may allow the walls of the package 200 to be selectively opened and closed. This mechanism 214 may allow the package 200 be unfolded, opened, filled with ice, and be resealed thereby sealing an environment inside the interior volume 212 of the package 200. As can be appreciated, the sealed environment inside the interior volume 212 provides a greater thermal barrier to the elements and/or environment outside of the package 200. In one embodiment, the closure mechanism 214 may seal the package 200 such that the package is watertight.

In one embodiment, the package 200 may include a first width, W1, disposed at or adjacent to an upper portion 216A of the package 200 and a smaller second width, W2, disposed toward or adjacent to a lower portion 216B, 216C of the package 200 adjacent to a center of the package 200 and/or the base 208. This difference in widths (e.g., W1-W2) may provide a taper in the interior volume 212 of the package 200. The taper may also be defined by a taper angle, θ, taken from an edge of the package 200 adjacent to the upper portion 216A and an edge of the package 200 adjacent to the center of the package 200 and/or the base 208. As can be appreciated, the taper angle, θ, and/or width (e.g., W2, W2, etc.) may be adjusted to increase a size of the space for each of the cooling volumes 218 disposed on the sides of the canned beverages 110.

As illustrated in FIG. 2C, the unfolded and opened package 200 includes and interior volume 212, or compartment, that is sized to receive a plurality of canned beverages 110 and ice 120 surrounding at least a portion of the canned beverages 110. It is an aspect of the present disclosure that the package 200 is shaped and sized such that the ice 220 is directed to cool multiple sides of the canned beverages 110 contained therein. In one embodiment, this shape and size may be at least partially defined by the taper of the package 200 and interior volume. FIG. 2C, shows ice 220 that is disposed on a top of the canned beverages 110, in between the front wall 202A and the canned beverages 110 at one or more cooling volumes 218, and in between the sides of the package 200 and the canned beverages 110 at one or more cooling volumes 218.

Figure 3C:
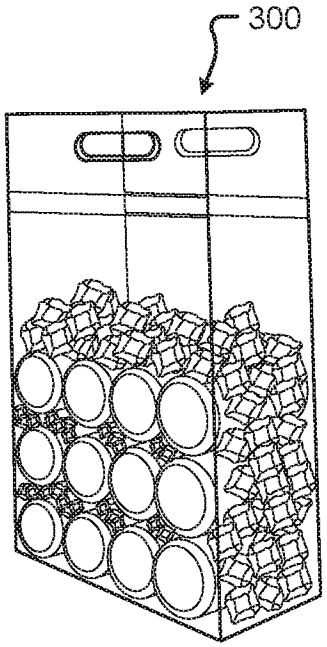
FIG. 3C shows a perspective view of the convertible beverage container package having the integrated cooler compartment of FIG. 3B filled to a level with ice.
Figure 3B:
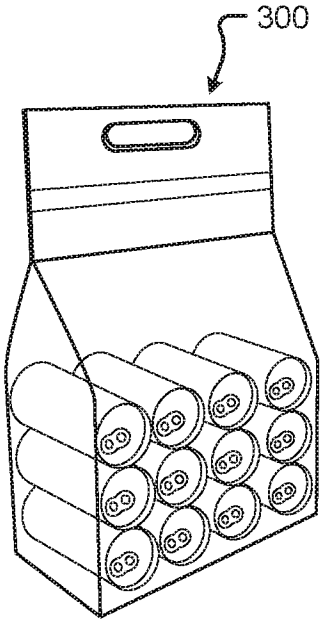
FIG. 3B shows a perspective view of the convertible beverage container package having the integrated cooler compartment of FIG. 3A in an unfolded state.
Figure 3A:
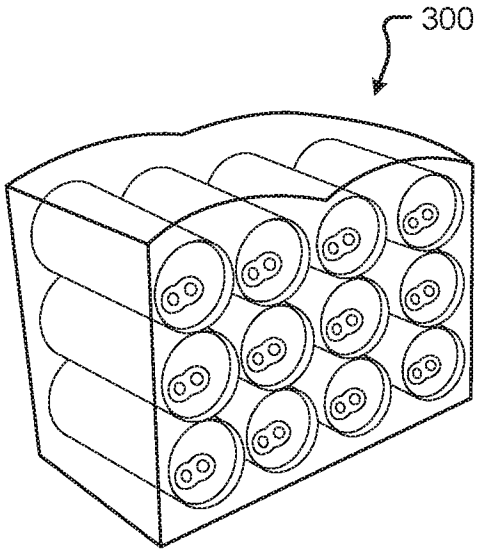
FIG. 3A shows a perspective view of a convertible beverage container package having an integrated cooler compartment in accordance with embodiments of the present disclosure.

FIGS. 3A-3C show various perspective views of a convertible beverage container package having an integrated cooler compartment, or package, 300 in accordance with embodiments of the present disclosure. The material, structure, and/or manufacture of the package 300 may be similar, if not identical, to the material, structure, and/or manufacture of the packages 100, 200 described in conjunction with FIGS. 1A-2C, and as such, any description of the same may equally apply to the package 300 of FIGS. 3A-3C and/or any other package 400, 500, 600, 700 described in conjunction with FIGS. 4A-7C, and vice versa.

The package 300 in FIGS. 3A-3C may be manufactured from three or more separate walls, comprising the front and rear walls and the side walls. In one embodiment, the front wall may be separate from the rear wall and each side wall. For instance, each wall of the package 300 may be a separate piece of material that is joined together to form the formed package 300. In some cases, the package 300 may include a separate wall for the base of the package 300. In this example, the package may comprise at least five walls.

As illustrated in FIGS. 3A-3C, the perspective views show examples of the package 300 in a packaged, or "retail," state (see FIG. 3A), in an unfolded, or "home," state (see FIG. 3B), and in a portable cooler carrying state filled with ice (see FIG. 3C).

FIGS. 4A-4C show various perspective views of a convertible beverage container package having an integrated cooler compartment, or package, 400 in accordance with embodiments of the present disclosure. The material, structure, and/or manufacture of the package 400 may be similar, if not identical, to the material, structure, and/or manufacture of the packages 100, 200, 300 described in conjunction with FIGS. 1A-3C, and as such, any description of the same may equally apply to the package 400 of FIGS. 4A-4C and/or any other package 500, 600, 700 described in conjunction with FIGS. 5A-7C, and vice versa.

The package 400, as shown in FIG. 4A may include a separate packaging sleeve 404 with integrated handle 408. In some embodiments, the separate packaging sleeve 404 may be a die-cut paperboard, or cardboard, sleeve that wraps around the package 400. In one embodiment, the separate packaging sleeve 404 may be held in place via one or more locking features, adhesives, and/or adhesive labels. While any of the packages 100-700 described herein may be decorated (e.g., with graphics, advertising, branding, codes, etc.) the separate packaging sleeve 404 of FIG. 4A may offer a number of surface configured to receive decorations.

As illustrated in FIGS. 4A-4C, the perspective views show examples of the package 300 in a packaged, or "retail," state (see FIG. 4A), in an unfolded, or "home," state (see FIG. 4B), and in a portable cooler carrying state filled with ice (see FIG. 4C).

FIGS. 5A-5M show various perspective views of a convertible beverage container package having an integrated cooler compartment, or package, 500 in accordance with embodiments of the present disclosure. The material, structure, and/or manufacture of the package 500 may be similar, if not identical, to the material, structure, and/or manufacture of the packages 100, 200, 300, 400 described in conjunction with FIGS. 1A-4C, and as such, any description of the same may equally apply to the package 500 of FIGS. 5A-5C and/or any other package 600, 700 described in conjunction with FIGS. 6A-7C, and vice versa.

Figure 5B:
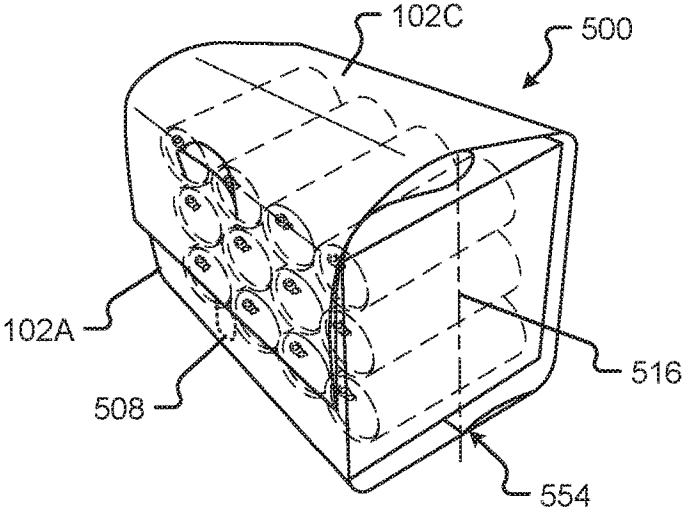
FIG. 5B shows a perspective view of the convertible beverage container package having the integrated cooler compartment of FIG. 5A in a first folded state.
Figure 5C:
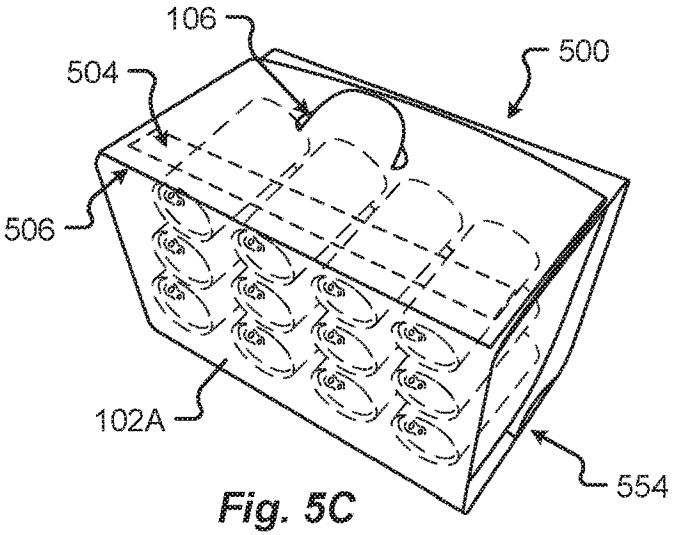
FIG. 5C shows a perspective view of the convertible beverage container package having the integrated cooler compartment of FIG. 5A in a second folded state.
Figure 5A:
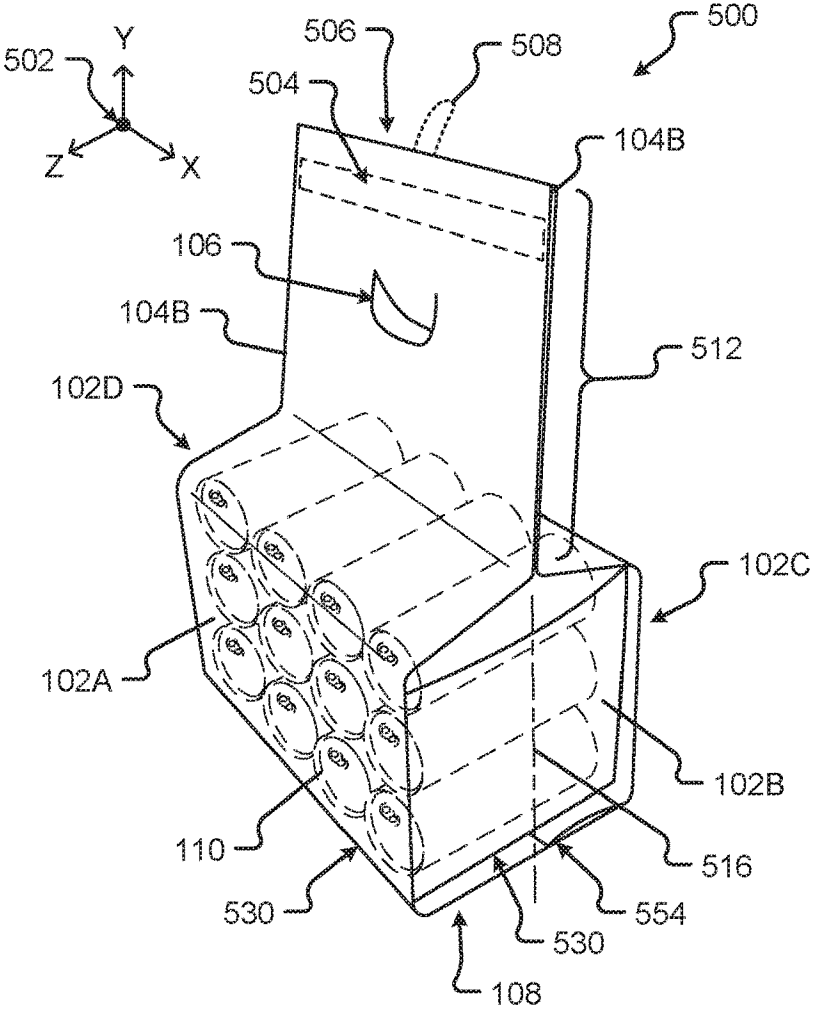
FIG. 5A shows a perspective view of a convertible beverage container package having an integrated cooler compartment in accordance with embodiments of the present disclosure.

The convertible beverage container package 500 of FIG. 5A is shown as including a number of canned beverages 110 disposed within an internal compartment of the package 500. Although shown as including six canned beverages 110 oriented adjacent to one another in an axis-horizontal position (e.g., the axis of the cylindrical shape of each of the canned beverages 110 may be substantially parallel with a table, shelf, or other base contacting surface etc.), it should be appreciated that the convertible beverage container package 500 may contain and carry any number of cans in any orientation. For instance, the convertible beverage container package 500 may be configured to carry, store, and/or contain two, four, six, eight, nine, twelve, sixteen, eighteen, twenty-four, thirty-six, forty-eight, and/or any combination of canned beverages 110 in the internal compartment. Additionally or alternatively, the convertible beverage container package 500 may be configured to carry, store, and/or contain the canned beverages 110 in an upright, axis-vertical, state during transport and/or storage.

Among other things, arranging the canned beverages 110 in an axis-horizontal orientation inside the convertible beverage container package 500, as shown in FIG. 5A, provides a stable package 500, whether the package 500 is in a folded (e.g., retail) state or in an unfolded (e.g., home/ice) state, for instance, when the canned beverages 110 and the ice 120 are each transported in the compartment 112. As can be appreciated, when ice 120 is added to the compartment 112 when the package 500 is in the unfolded state, and when the package 500 is moved, the low center of gravity of each of the canned beverages 110 arranged in the axis-horizontal orientation cannot topple like canned beverages 110 arranged in an axis-vertical orientation. Another benefit of arranging the canned beverages 110 in an axis-horizontal orientation inside the convertible beverage container package 500 is that when ice 120 is added to the compartment 112, the sidewalls of the horizontally arranged canned beverages 110 provide a larger surface area disposed inside the ice 120. This arrangement provides more efficient heat transfer by, among other things, exposing the thinnest part of the canned beverages 110, the sidewalls, to the cooling medium, ice 120 (ice water, etc.), such that the canned beverages 110 and product cools faster than canned beverages 110 arranged in an axis-vertical orientation in the same space.

The convertible beverage container package 500 may include a number of material panels, or walls, 102A-D joined together to form the bag-shape of the package 500. As previously described, the walls 102A-D may be joined by one or more of heat-sealing, staking, melting, welding, gluing, adhering, folding, crimping, etc., and/or combinations thereof. The convertible beverage container package 500. As shown in FIG. 5A, the convertible beverage container package 500 may include a front wall 102A disposed opposite a rear wall 102C. In one embodiment, the front wall 102A may be attached to the rear wall 102C via an edge area seal. Additionally or alternatively, the front wall 102A may be attached along each side to respective side walls 102B, 102D, which may then be attached to the rear wall 102C along each side.

In some embodiments, the convertible beverage container package 500 may include a base 108, an internal compartment 112 (e.g., configured to receive canned beverages 110 and/or other objects, when expanded, etc.), and an upper portion 512. The upper portion 512 may include a handle 106, one or more package closures 504, a package seal 508, and may even define an area that, in an opened state (e.g., as shown in FIGS. 5D-5E and 5H-5J) is configured to provide a volume for receiving ice 120 and/or some other cooling medium (chilled water, ice water, ice substitutes, gel-insulated ice substitutes, etc.).

As shown in FIG. 5A, the package closure 504 may be disposed above the handle 106. In this position, the package closure 504 may provide additional material and strength for the handle 106 to support the weight of a loaded package 500. In one embodiment, the package closure 504 may be configured to provide a re-sealable closure between the front wall 102A and the rear wall 102C of the package 500. This package closure 504 may include, but is in no way limited to, a hook-and-loop closure system, an interlocking element closure system, interlocking molded micro hook system, re-sealable zipper system, etc., and/or combinations thereof. In some embodiments, the convertible beverage container package 500 may include a package closure 504 arranged above and below the handle 106, for example, disposed on both sides of the handle 106 in the Y-axis direction, shown via coordinate system 502. The construction of the convertible beverage container package 500 in a flattened state can provide a number of seamless bends 530 disposed at corners of the convertible beverage container package 500 in the formed states (e.g., the packaged and cooler states). Among other things, these seamless bends 530 can eliminate stress concentrations on the package while in transit or storage, provide a smooth transition (e.g., non-sharp, soft, radius, etc., bend) between substantially orthogonally disposed walls 102A-D, and can even provide a region between the canned beverages 110 and the walls 102A-D for ice 120 and/or other cooling medium to move. It is an aspect of the present disclosure that the edges for each of the walls 102A-D has a seamless bend 530.

Another benefit of the formed shape of the convertible beverage container package 500 and the seamless bend 530 includes increased structural integrity in a loaded packaged and/or cooler state. In addition to moving the forces from the weight of product inside the convertible beverage container package 500 away from the seam seals, the folded edge 554 of the package 500 runs substantially along a center of the package 500, in the X-axis direction, providing a reinforced amount of material supporting the contents of the convertible beverage container package 500. The unshaped, or flattened state, of the package 500 highlighting the construction of the convertible beverage container package 500 is described in conjunction with FIG. 5K.

It is an aspect of the present disclosure that the convertible beverage container package 500 may be formed from a flattened state into a packaged state and then a cooler state. In the flattened state the convertible beverage container package 500 does not include any objects (e.g., canned beverages 110, ice 120, etc.) disposed therein. The packaged state may include a folded packaged state and an unfolded packaged state. In the folded packaged state, the convertible beverage container package 500 may be configured for containing the contents inside the compartment 112 (e.g., in a retail environment, storage environment, etc.), while providing one or more substantially planar exterior surface areas of the package 500 for decoration, advertising, information, etc. The folded packaged state may appear as a rectangular cuboid shape as at least described in conjunction with FIGS. 5B and 5C. In the unfolded packaged state (e.g., shown in FIG. 5A), the convertible beverage container package 500 may be configured to transport the contents of the package 500 from a retailer, or elsewhere, by exposing the handle 106 from its concealed position (e.g., in the folded packaged state) to a revealed position. The cooler state of the convertible beverage container package 500 may be described in conjunction with FIGS. 5D-5J, and can include opening access to the compartment 112 of the package 500 by, for example, separating the front wall 102A from the rear wall 102C via the package closure 504. Once separated, or opened, the first side wall 102B and the second side wall 102D may maintain the package 500 in an open state where the front wall 102A and rear wall 102C are separated from one another.

In some embodiments, the upper portion 512 may be folded over an edge of the front wall 102A or the rear wall 102C for the folded packaged state. This first folded packaged state may be as shown in FIG. 5B. In FIG. 5B, the upper portion 512 is folded from an approximate center of the convertible beverage container package 500 (e.g., at or adjacent to the centerline 516 running along the Y-axis direction), over an edge of the canned beverages 110 and secured to a surface of the front wall 102A or the rear wall 102C. In some embodiments, the opening end of the upper portion 512 may be temporarily fastened against the front or rear walls 102A, 102C with a package seal 508. The package seal 508 may be an adhesive strip or tab, tape, a sticker, etc., configured to temporarily fasten the upper portion 512 to the front or rear walls 102A, 102C of the package 500 in the folded packaged state.

In one embodiment, the upper portion 512 may be folded on a portion of the top side of the package 500 when in the rectangular cuboid shaped packaged state as shown in FIG. 5C. For instance, the upper portion 512 may be folded at or about the center of the convertible beverage container package 500 and bent in a first direction toward one of the front or rear walls 102A, 102C such that the upper portion 512 lies substantially parallel and/or coincident with the surface of the top side of the packaged state package 500. In some embodiments, the upper portion 512 may have a dimension, or length, that requires the upper portion 512 to again be folded at, or adjacent to, the edge of the rectangular cuboid shaped packaged state in a direction opposite the first direction, such that the entirety of the upper portion 512 is contained within an overall width and length of the rectangular cuboid shaped packaged state package 500 (e.g., inside, or substantially inside, the area of the top side of the package 500 when in the rectangular cuboid shaped packaged state).

Figure 5E:
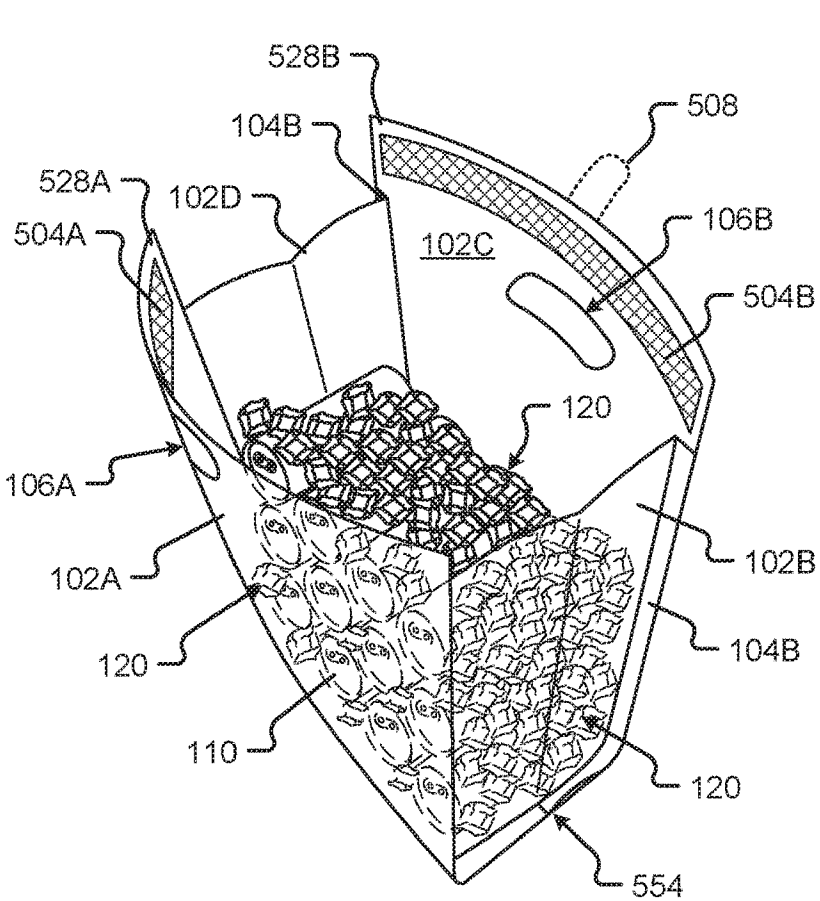
FIG. 5E shows a perspective view of the convertible beverage container package having the integrated cooler compartment of FIG. 5D filled to a level with ice.
Figure 5D:
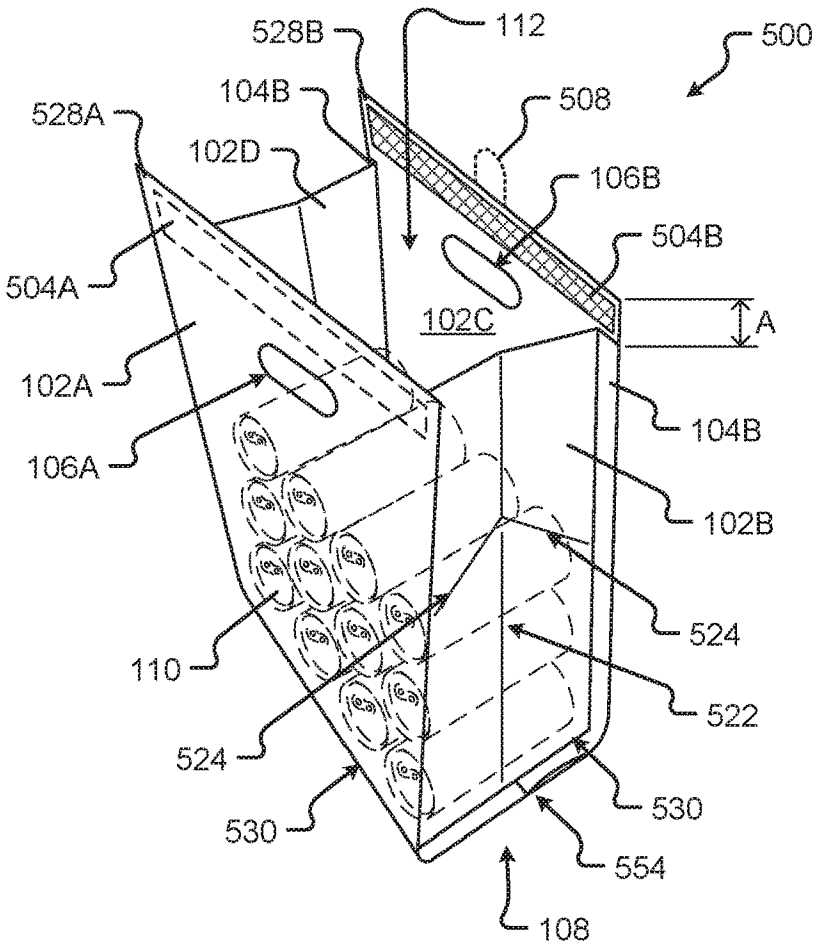
FIG. 5D shows a perspective view of the convertible beverage container package having the integrated cooler compartment of FIG. 5A in an unfolded state.
Figure 5G:
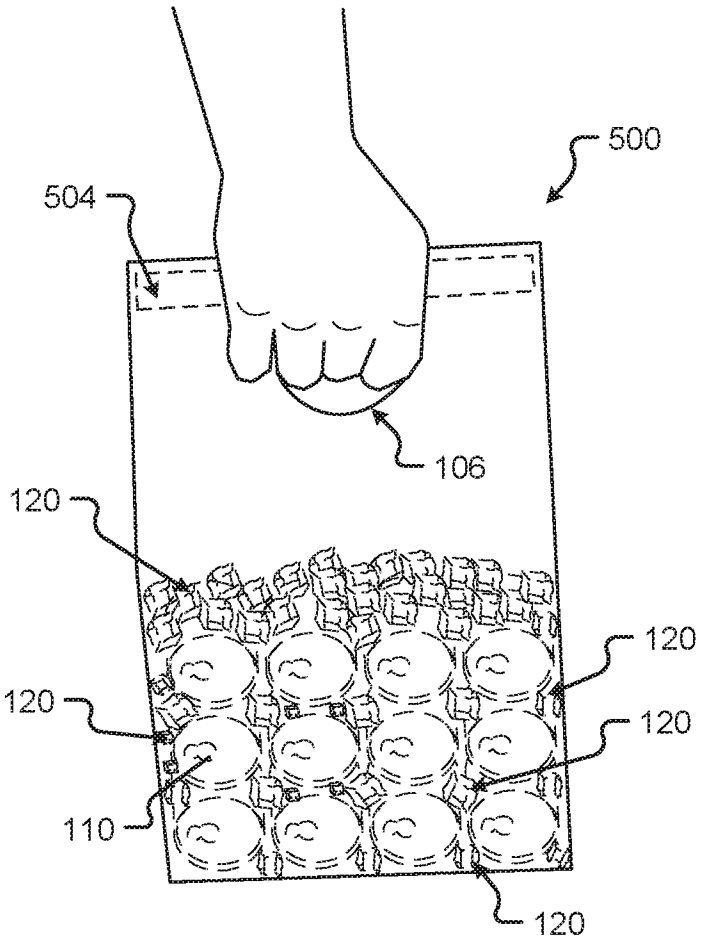
FIG. 5G shows a perspective view of the convertible beverage container package having the integrated cooler compartment of FIG. 5F in transport.

FIGS. 5D-5E show perspective views of the convertible beverage container package 500 in an opened state. Side elevation views of the convertible beverage container package 500 shown in FIGS. 5D-5E are shown in FIGS. 5H-5J, respectively. In FIGS. 5D-5E and 5H-5J the front wall 102A has been separated from the rear wall 102C by pulling the walls 102A, 102C apart from one another (e.g., in opposite directions from the center of the package 500). As a user pulls the walls 102A, 102C apart, the forces from pulling separate the interconnection of the package closure 504. In particular, the pull forces detach the first package closure element 504A from the second package closure element 504B. This opened state provides access to the internal compartment 112 of the package 500 at the opening end 506.

The convertible beverage container package 500 shown in FIGS. 5D-5E and FIGS. 5H-5J show the front and rear walls 102A, 102C having first and second extended panels 528A, 528B, respectively, extending a dimension, A, above the uppermost edge of the side walls 102B, 102D. The first and second extended panels 528A, 528B may be an extension of the material comprising the front and second wall 102A, 102C. These extended panels 528A, 528B may include an area for the first package closure element 504A and the second package closure element 504B, respectively. In some embodiments, the first and second package closure elements 504A, 504B may be discrete elements that are mechanically bonded to (e.g., welded, heat-sealed, adhered, etc.) the first and second extended panels 528A, 528B. In one embodiment, the first and second package closure elements 504A, 504B may be integrally formed from (e.g., molded, etc.) the first and second extended panels 528A, 528B, respectively.

FIGS. 5D and 5H shows views of the convertible beverage container package 500 with an open compartment 112. In this state, the canned beverages 110 disposed inside the convertible beverage container package 500 are accessible from the opening end 506 of the package 500.

Each of the side walls 102B, 102D of the convertible beverage container package 500 may be formed to include a fold line 522 running substantially from the top to the bottom of the package 500. As the package 500 is closed, these fold lines 522 may move toward a center of the package 500 while allowing the front and rear walls 102A, 102C to meet at the package closure 504. Once folded into a packaged state (as shown in FIGS. 5A-5C) one or more secondary fold lines 524 may be formed extending from the fold line 522 to the front and rear walls 102A, 102C.

FIGS. 5E and 5J show views of the convertible beverage container package 500 filled partially with ice 120. As shown in FIGS. 5E and 5J, the internal volume of the package 500 may be expanded by adding ice 120 and/or some other cooling medium. For instance, as ice 120 is added inside the compartment 112, the distance from the front wall 102A to the rear wall 102C in FIGS. 5E and 5J (e.g., distance B2) may increase over the distance between walls 102A, 102C shown in FIGS. 5D and 5H (e.g., distance B1). Additionally or alternatively, as ice 120 is added to the compartment 112, the distance from the first side wall 102B to the second side wall 102D may increase over the distance between walls 102B, 102D shown in FIG. 5D. The convertible beverage container package 500 may include a fill line, or other indicia, indicating a maximum level of ice 120 that still allows the package 500 to be closed via the package closure 504.

It is an aspect of the present disclosure that the convertible beverage container package 500 is made from a flexible material, and as the ice 120 is added to the compartment 112, the material may deform additionally increasing an internal volume of the compartment 112. In some embodiments, one or more of the walls 102A-D may be slightly angled relative to one another and/or the base 108. This disposition of the walls 102A-D may serve as a funnel, directing ice 120, ice water, and/or other cooling media toward the canned beverages 110 inside the compartment 112. For instance, the tapered shape may direct ice 120 along multiple sides of the canned beverages 110 contained in the package 500. In one embodiment, the tapered shape of the package 500 may provide a number of cooling volumes (e.g., similar, if not identical to the cooling volumes 218 described in conjunction with FIG. 2B, etc.) disposed around a number of sides of the canned beverages 110 such that ice 120 inserted into the package is held in the interior compartment 112 and the cooling volumes of the package 500 while in contact with the canned beverages 110.

Figure 5F:
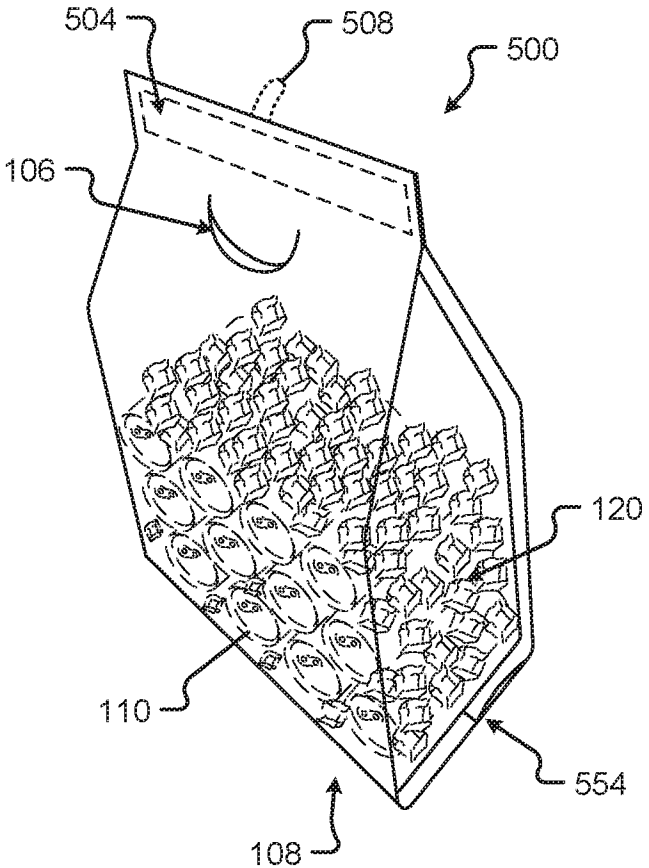
FIG. 5F shows a perspective view of the convertible beverage container package having the integrated cooler compartment of FIG. 5E closed for portability.
Figure 5J:
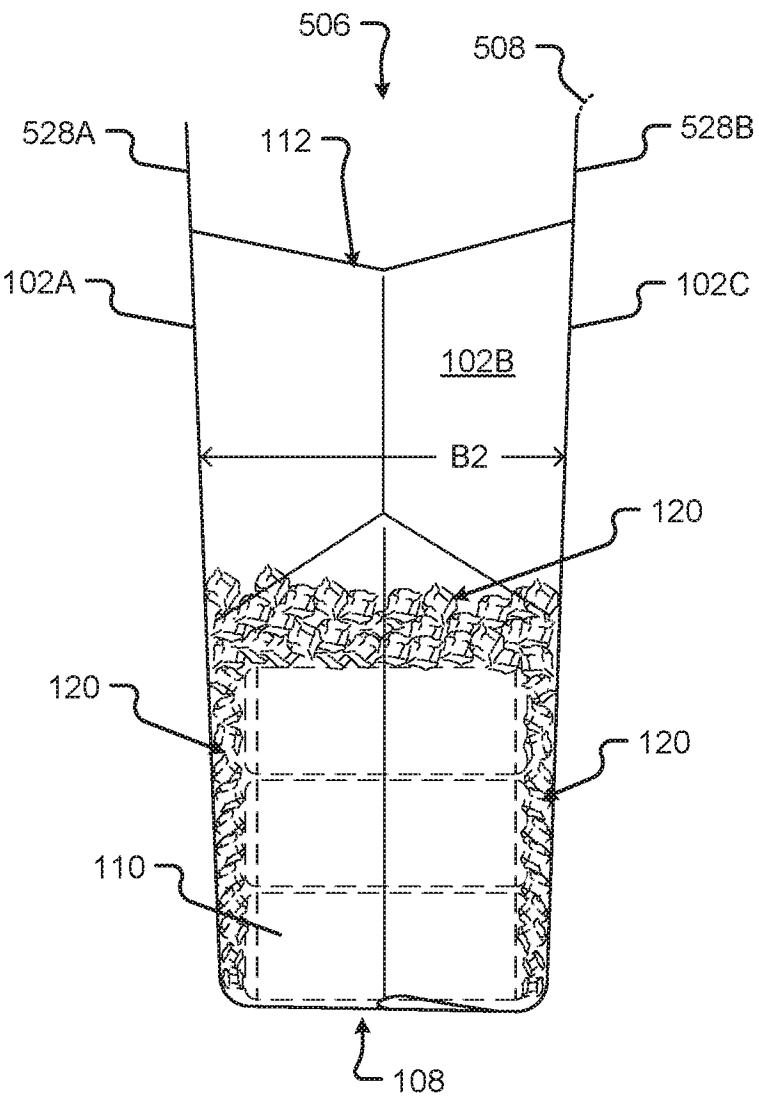
FIG. 5J shows a side elevation view of the convertible beverage container package having the integrated cooler compartment of FIG. 5E.
Figure 5H:
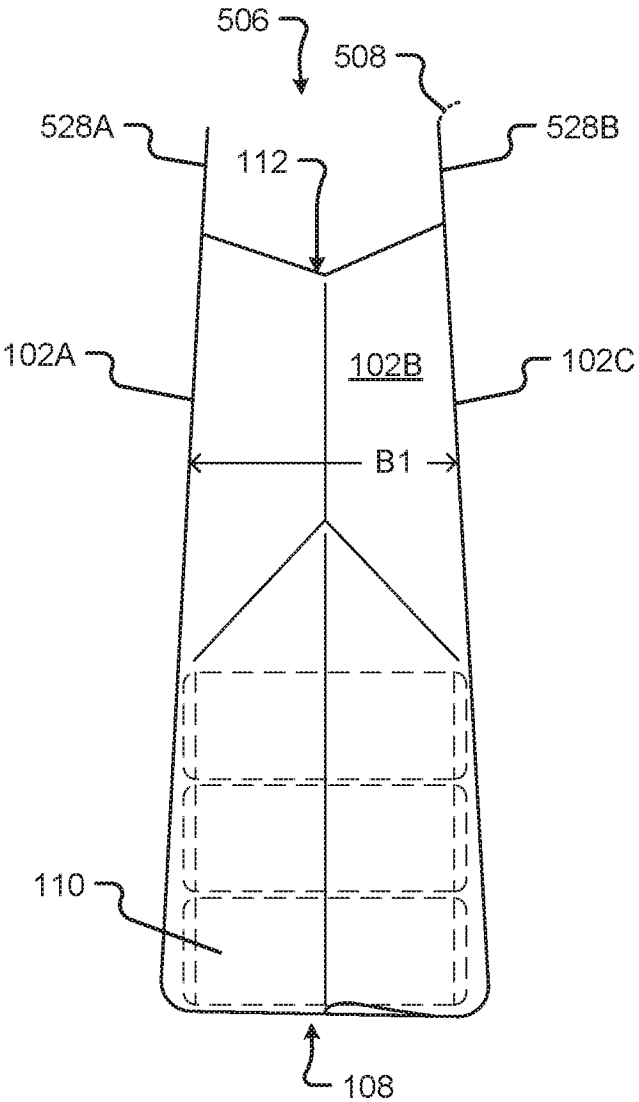
FIG. 5H shows a side elevation view of the convertible beverage container package having the integrated cooler compartment of FIG. 5D.

Once the convertible beverage container package 500 is filled with ice 120, the front wall 102A may be closed together, and held in contact, with the rear wall 102C via the package closure 504, as shown in FIG. 5F. The handle 106 may be sized to allow a user to insert two or more fingers for carrying the convertible beverage container package 500 loaded with canned beverages 110 and ice 120, as shown in FIG. 5G. It is an aspect of the present disclosure that as the ice 120 melts in the compartment 112, the cooled ice water and remaining ice 120 may fill further into the various gaps between the canned beverages 110 inside the package 500. In any event, the package 500 is waterproof and can hold a compartment 112 full of water without leaking.

Figure 5K:
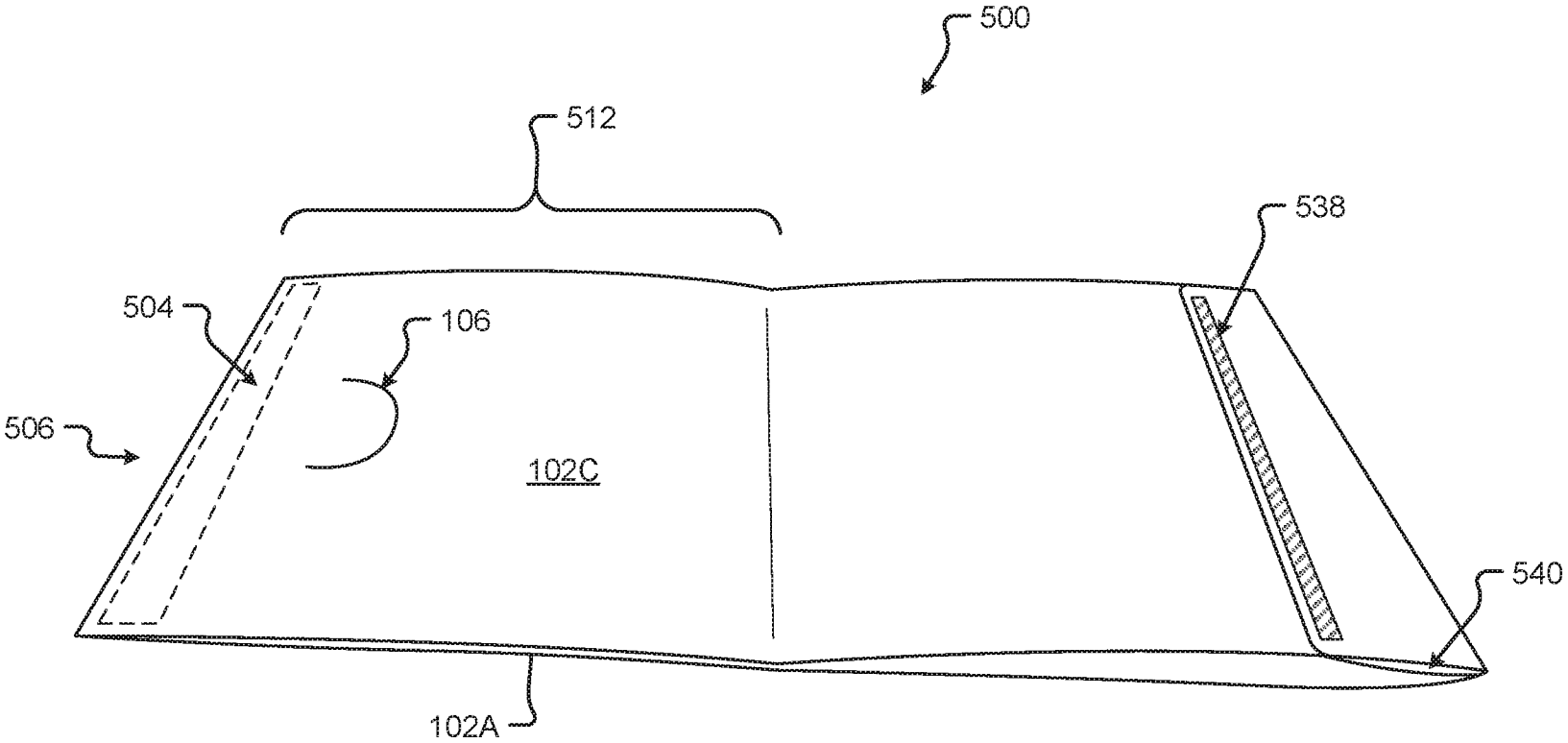
FIG. 5K shows a perspective view of the convertible beverage container package having the integrated cooler compartment in a flattened and formed state.
Figure 5M:
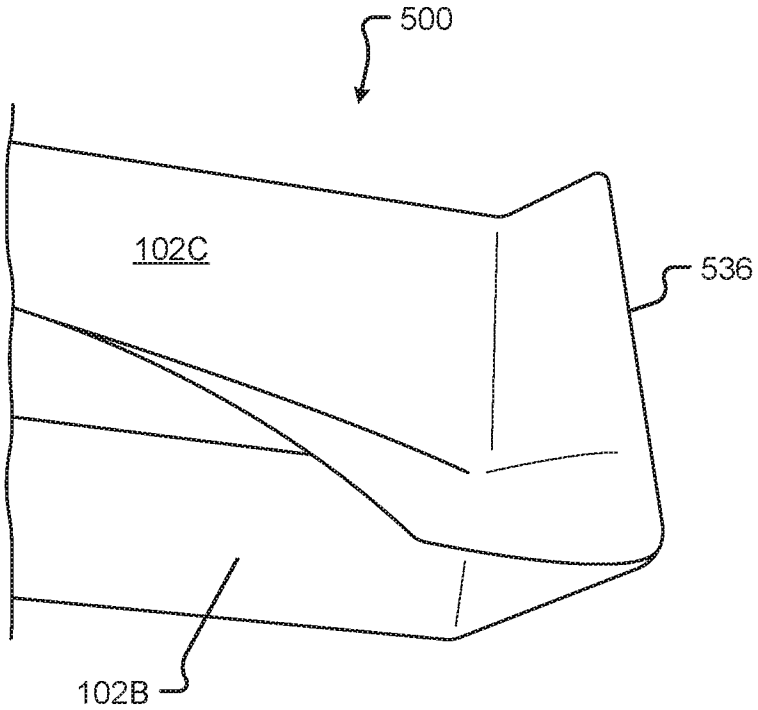
FIG. 5M shows a perspective view of the folded panels disposed at the closed end of the convertible beverage container package having the integrated cooler compartment in the first formed state.
Figure 5L:
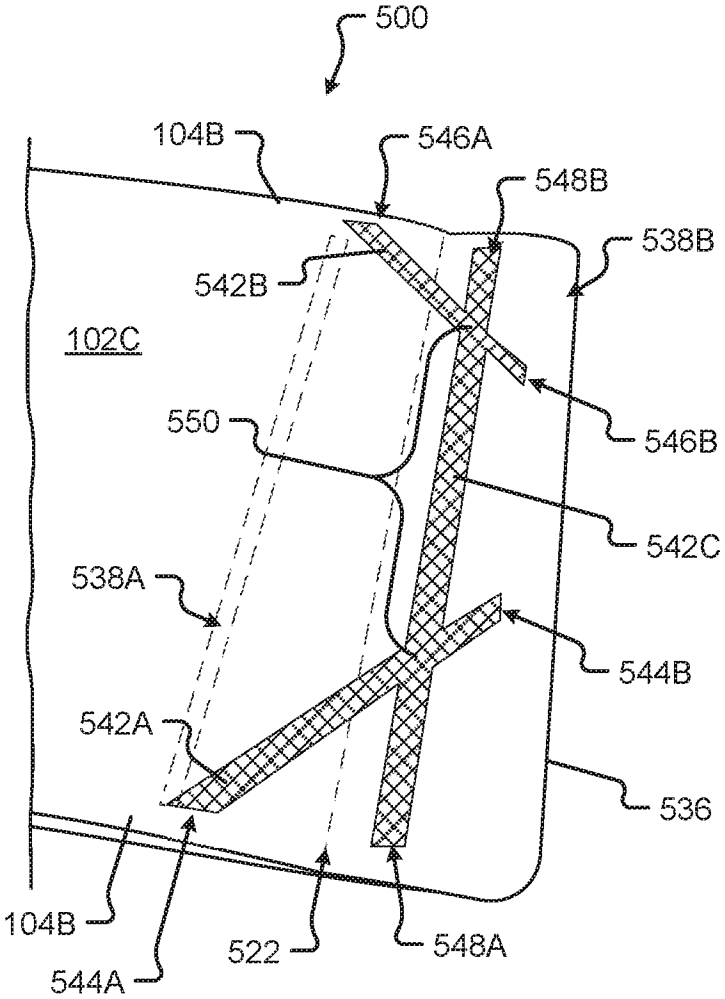
FIG. 5L shows a perspective view of a closed end of the convertible beverage container package having the integrated cooler compartment in a flattened and first formed state.
Figure 5N:
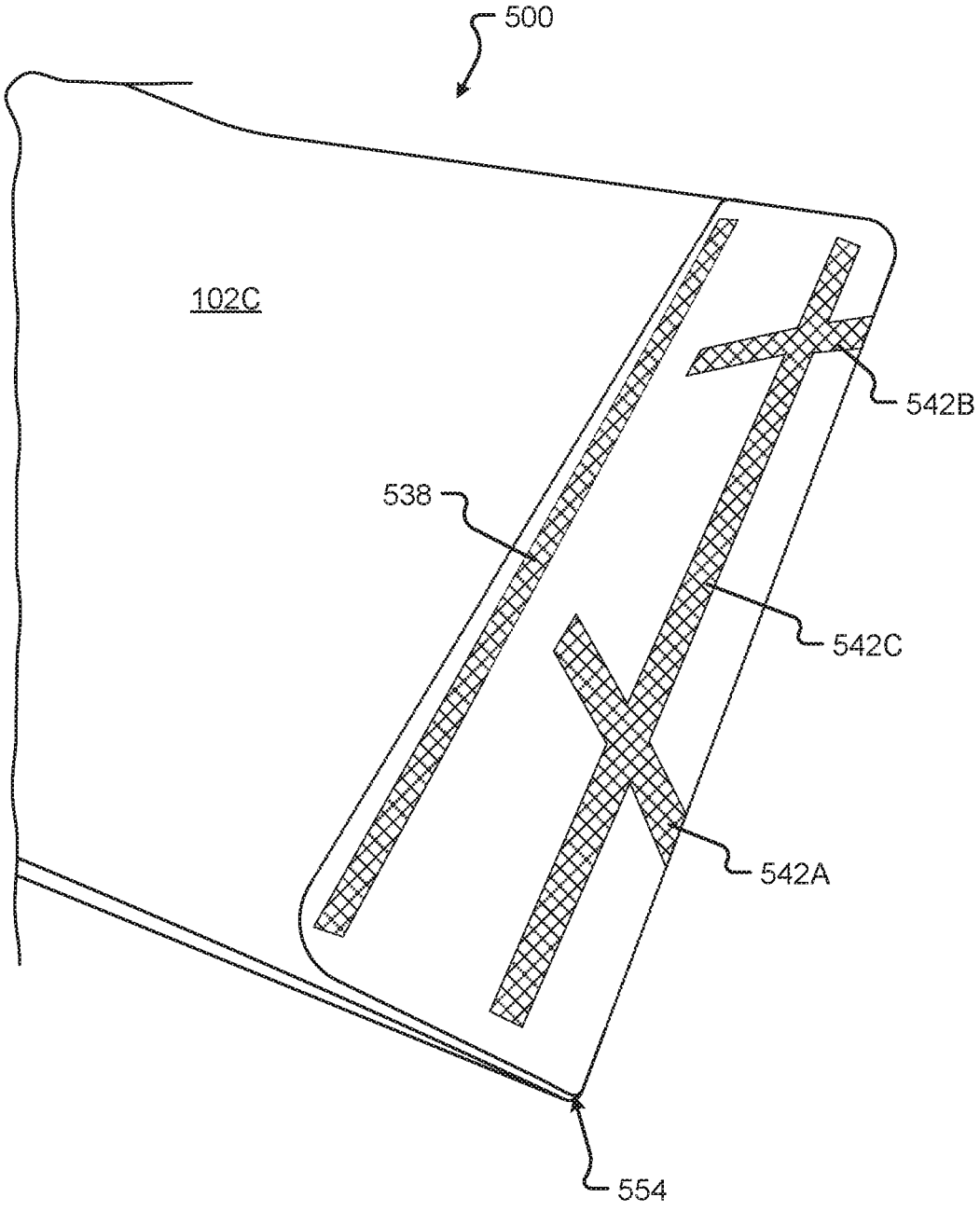
FIG. 5N shows a perspective view of the closed end of the convertible beverage container package having the integrated cooler compartment in a second formed state.

Referring now to FIGS. 5K-5N, various views of the convertible beverage container package 500 in a flattened state are shown in accordance with embodiments of the present disclosure. In particular, FIGS. 5K and 5N show the package 500, or portions thereof, in a sealed state ready to be formed for receiving canned beverages 110, while FIGS. 5L-5M show the base portion of the package 500 as the seals of the compartment 112 are formed.

FIG. 5K shows a perspective view of the convertible beverage container package 500 in a flattened and formed state. As shown in FIG. 5K, the flattened package 500 is lying front wall 102A side down with the rear wall 102C facing upward. In the flattened state, the front wall 102A may contact the rear wall 102C at portions of the compartment 112 and the package closure 504. The top, or opening end 506, of the package 500 may be disposed at the end of the upper portion 512 having the package closure 504 and the base 108 may be formed at the end of the package 500 including the reinforced base area 540.

FIG. 5L shows a perspective view of the closed end of the convertible beverage container package 500 in a flattened and first formed state. In this state, a number of seals have already been made to the package 500. For instance, the front wall 102A is bonded or joined to the first side wall 102B along a side edge 104B, the second side wall 102D along a side edge 104B, and to the rear wall 102C along the bottom edge 536 of the package 500. In addition, the rear wall 102C is bonded or joined to the first side wall 102B along a side edge 104B and to the second side wall 102D along a side edge 104B of the package 500. These seals, or joins, may follow a portion of the perimeter of the front and rear walls 102A, 102C along the side edges 104B and the bottom edge 536. In one embodiment, the seals, or joins, would stop at the opening end 506 of the convertible beverage container package 500.

A number of seals may be formed in the various layers (e.g., walls 102A-D, etc.) of the package to provide reinforcement features, shaping features, contours, and/or other geometries that alter the shape of the convertible beverage container package 500 when formed to receive canned beverages 110 and/or ice 120.

For instance, the first interior shape seal 542A may seal the rear wall 102C to the first side wall 102B along a length extending from the first seal area 544A to the second seal area 544B. This first interior shape seal 542A may taper, slope, or angle from a side edge 104B of the package 500 toward a center of the package 500. In some embodiments, the first interior shape seal 542A may only seal the rear wall 102C to the first side wall 102B between the first seal area 544A and the third interior shape seal 542C. In one embodiment, the first interior shape seal 542A may overlap, or contact, a seal running along the side edge 104B. The second interior shape seal 542B may correspond to a symmetrical (e.g., about the center of the rear wall 102C, etc.) seal that joins the opposing side of the rear wall 102C to the second side wall 102D. The second interior shape seal 542B may seal the rear wall 102C to the second side wall 102D along a length extending from the first seal area 546A to the second seal area 546B. Similar to the first interior shape seal 542A, the second interior shape seal 542B may taper, slope, or angle from a side edge 104B of the package 500 toward a center of the package 500. In some embodiments, the second interior shape seal 542B may only seal the rear wall 102C to the second side wall 102D between the first seal area 546A and the third interior shape seal 542C. In one embodiment, the second interior shape seal 542B may overlap, or contact, a seal running along the side edge 104B.

The third interior shape seal 542C may define a bottom of the interior compartment 112 of the convertible beverage container package 500. In some embodiments, the third interior shape seal 542C may extend from the first seal area 548A to the second seal area 548B. In one embodiment, the third interior shape seal 542C may seal the front wall 102A to the rear wall 102C along the through-seal area 550 only. For example, the area of the third interior shape seal 542C extending from the first seal area 548A to the first interior shape seal 542A may be configured to only seal the rear wall 102C to the first side wall 102B along this region. As can be appreciated, the area of the third interior shape seal 542C extending from the second seal area 548B to the second interior shape seal 542B may be configured to only seal the rear wall 102C to the second side wall 102D along this region. As can be appreciated, the seals running along the side edges 104B meeting with the first interior shape seal 542A and the second interior shape seal 542B, which both meet at the third interior shape seal 542C, together form a waterproof internal compartment 112 for the convertible beverage container package 500.

The seals described in conjunction with FIG. 5L are also formed on the opposite side of the convertible beverage container package 500 in accordance with embodiments of the present disclosure. For instance, orienting the package 500 such that the front wall 102A is disposed in an upward facing direction, would allow the same types of seals to made joining the front wall 102A to the first side wall 102B, the second side wall 102D, and the rear wall 102C. Because these seals are symmetrical about a hypothetical plane running substantially parallel to, and between, the front and rear walls 102A, 102C, the description of forming the seals associated with FIG. 5L may equally apply to forming the seals between the front wall 102A, first side wall 102B, second side wall 102D, and the rear wall 102C.

As illustrated in FIG. 5L, the third interior shape seal 542C is disposed in a position offset from the base material fold line 552. In particular, the third interior shape seal 542C is arranged in a position along the rear wall 102C between the fold line 522 and the bottom edge 536 of the convertible beverage container package 500. Among other things, once the bottom edge 536 is folded at this fold line 522, such that the base material fold seal region 538A contacts the base material fold seal end portion 538B, the third interior shape seal 542C is not visible from the interior compartment 112 of the convertible beverage container package 500. This arrangement allows the seal to be protected (e.g., from internal forces, tearing, separation, etc.) when the convertible beverage container package 500 is formed into an un-flattened state and in a condition to receive canned beverages 110 and/or ice 120.

FIG. 5M shows a perspective view of the folded panels disposed at the closed end of the convertible beverage container package 500 in the first formed state. In particular, FIG. 5M illustrates that the rear wall 102C, while joined to the first side wall 102B (as described in conjunction with FIG. 5L), can separate from the front wall 102A of the package 500. Among other things, this gusseting seal arrangement provides a shaping feature for the convertible beverage container package 500 such that, when formed to receive canned beverages 110 and/or ice 120, the package 500 forms a base 108, and a bag-shaped number of walls 102A-D extending from the base 108 providing a substantially rectangular cuboid volume internal compartment 112 for receiving the canned beverages 110 and/or ice 120.

To complete the formation of the flattened state of the convertible beverage container package 500, the bottom portion of the package 500 including the bottom edge 536 is folded at the fold line 522 and the base material fold seal end portion 538B is sealed to the rear wall 102C at the base material fold seal 538. The base material fold seal 538 serves to secure the bottom edge 536 and the interior shape seals 542A-C along the base of the formed convertible beverage container package 500. As shown in FIG. 5N, the base material fold seal 538 may be made from the exposed surface of the bottom portion of the package 500, through the layers of material that were folded about the fold line 522 and to the rear wall 102C. However, the base material fold seal 538 does not pass through the interior compartment 112 of the package 500 to the front wall 102A on the other side of the compartment 112.

Figure 6A:
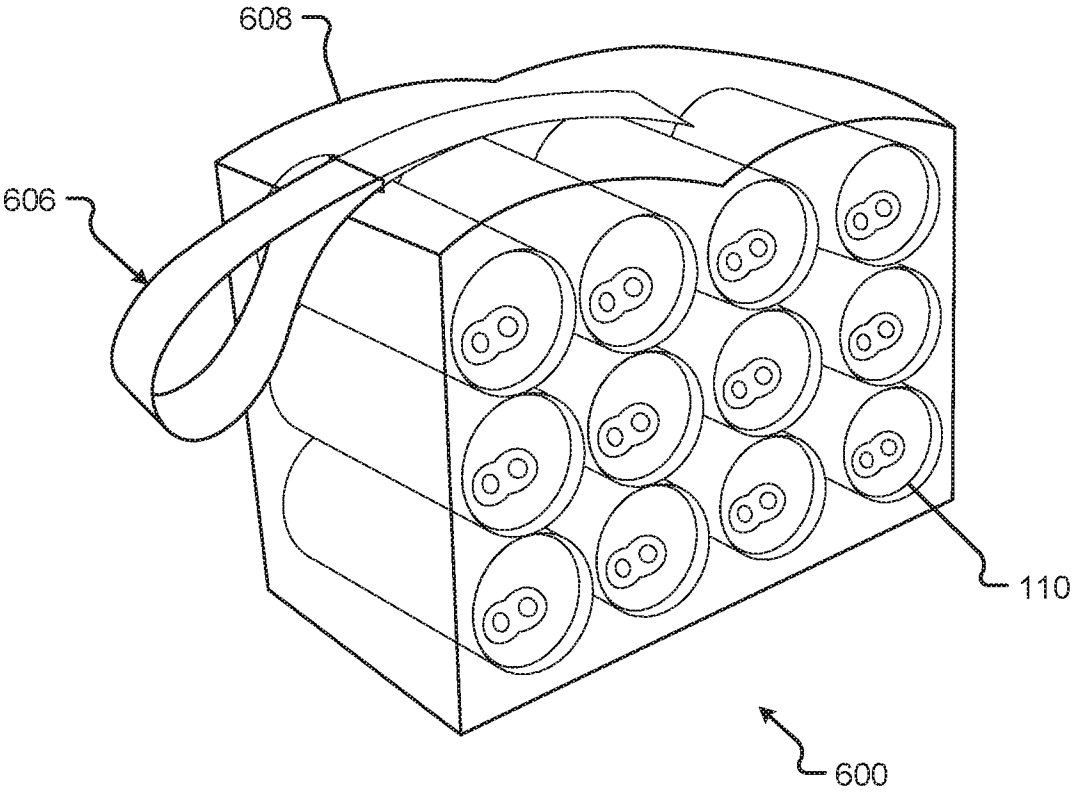
FIG. 6A shows a perspective view of a convertible beverage container package having an integrated cooler compartment in accordance with embodiments of the present disclosure.
Figure 6C:
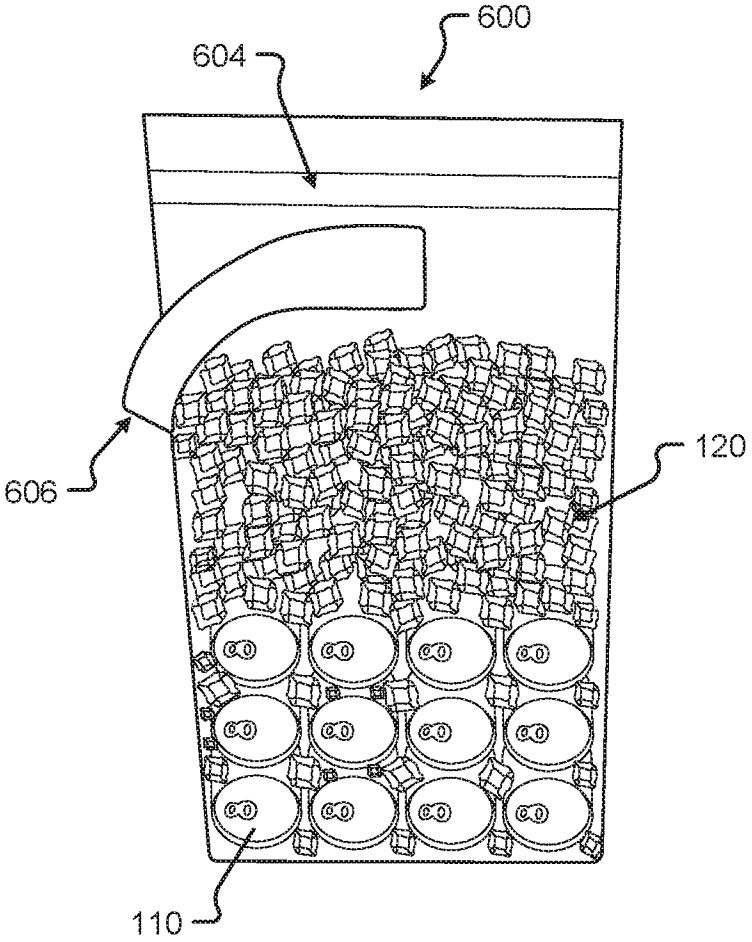
FIG. 6C shows a perspective view of the convertible beverage container package having the integrated cooler compartment of FIG. 6B filled to a level with ice.
Figure 6B:
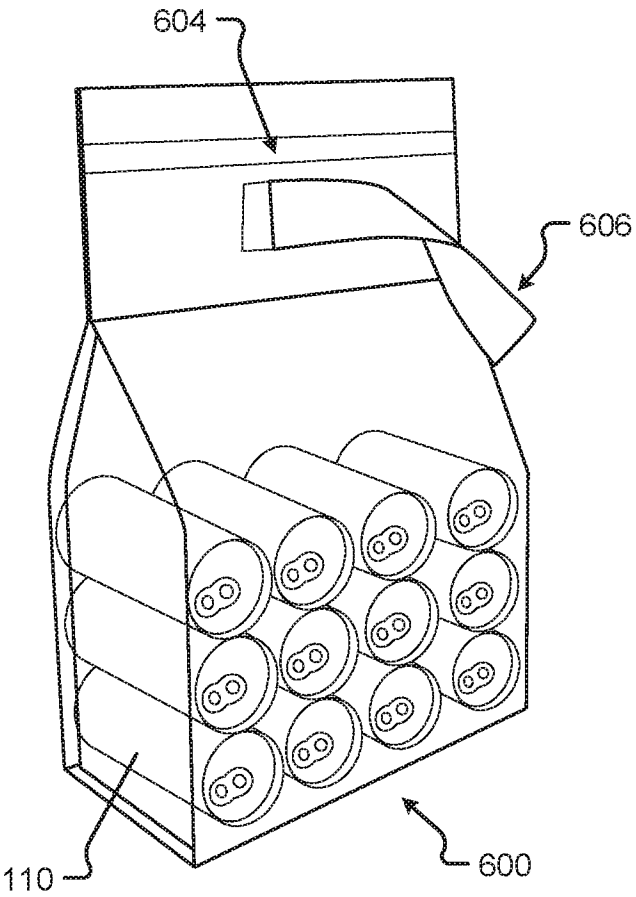
FIG. 6B shows a perspective view of the convertible beverage container package having the integrated cooler compartment of FIG. 6A in an unfolded state.

FIGS. 6A-6C show various perspective views of a convertible beverage container package having an integrated cooler compartment, or package, 600 in accordance with embodiments of the present disclosure. The material, structure, and/or manufacture of the package 600 may be similar, if not identical, to the material, structure, and/or manufacture of the packages 100, 200, 300, 400, 500 described in conjunction with FIGS. 1A-5C, and as such, any description of the same may equally apply to the package 600 of FIGS. 6A-6C and/or the other package 700 described in conjunction with FIGS. 7A-7C, and vice versa.

In some embodiments, the package 600 may include a vinyl sleeve 608 that encompasses the package 600. In one embodiment, a strap handle 606 may extend from the package through a hole, or slit, in the vinyl sleeve 608 such that a user can carry a package 600 of canned beverages 110 (e.g., from a retail setting to a home setting, etc.). After carrying the package 600 to a destination, the vinyl sleeve 608 may be removed and recycled, allowing the package 600 to be unfolded, as shown in FIG. 6B. Similar to the package closure 504 of FIGS. 5A-5N, the package closure system 604 shown in FIGS. 6B-6C is disposed above the strap handle 606 toward the opening end of the package 600. The package 600 may be opened via this closure system 604 and filled with ice 120 as described above, allowing the package 600 to be transported while cooling the canned beverages 110 therein.

Figure 7A:
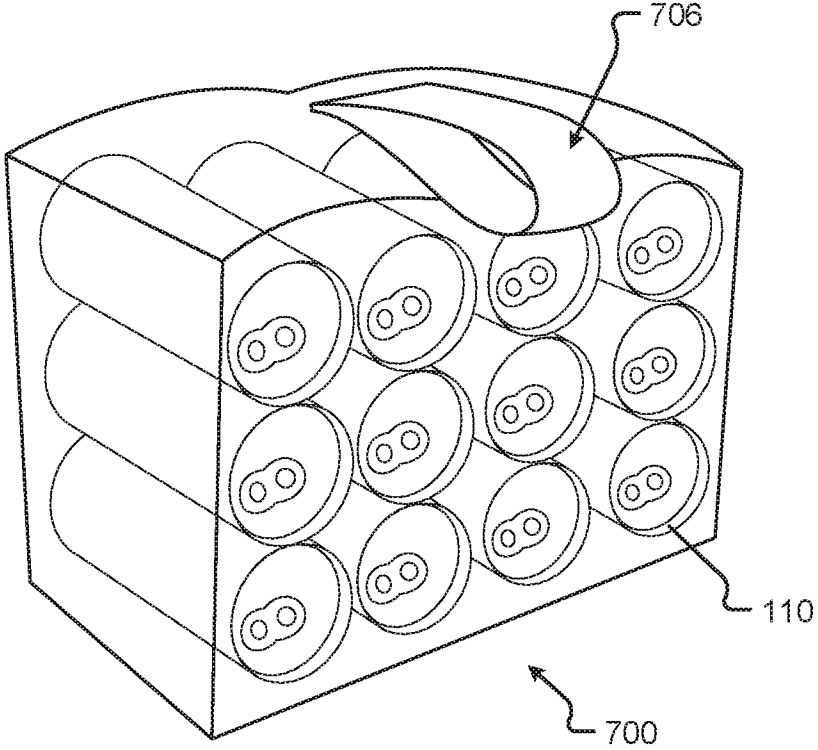
FIG. 7A shows a perspective view of a convertible beverage container package having an integrated cooler compartment in accordance with embodiments of the present disclosure.
Figure 7C:
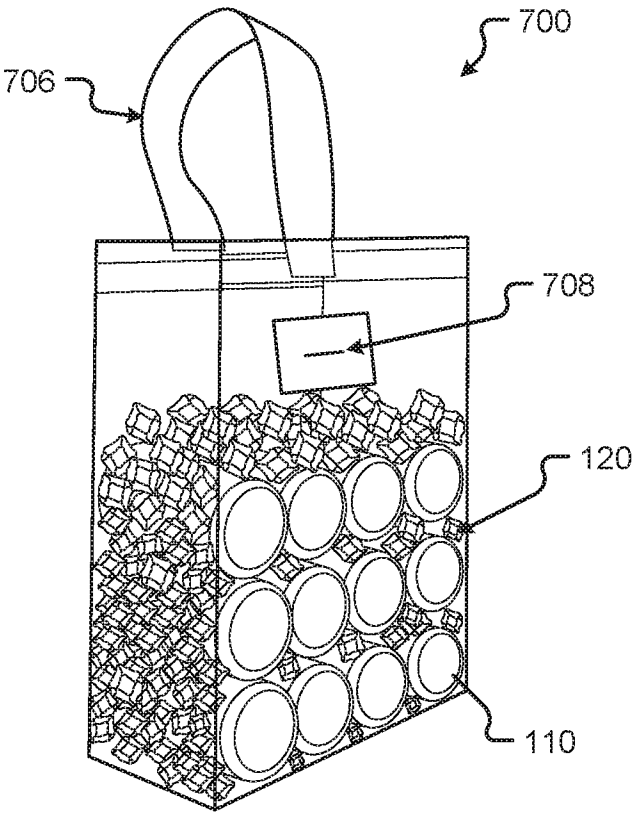
FIG. 7C shows a perspective view of the convertible beverage container package having the integrated cooler compartment of FIG. 7B filled to a level with ice.
Figure 7B:
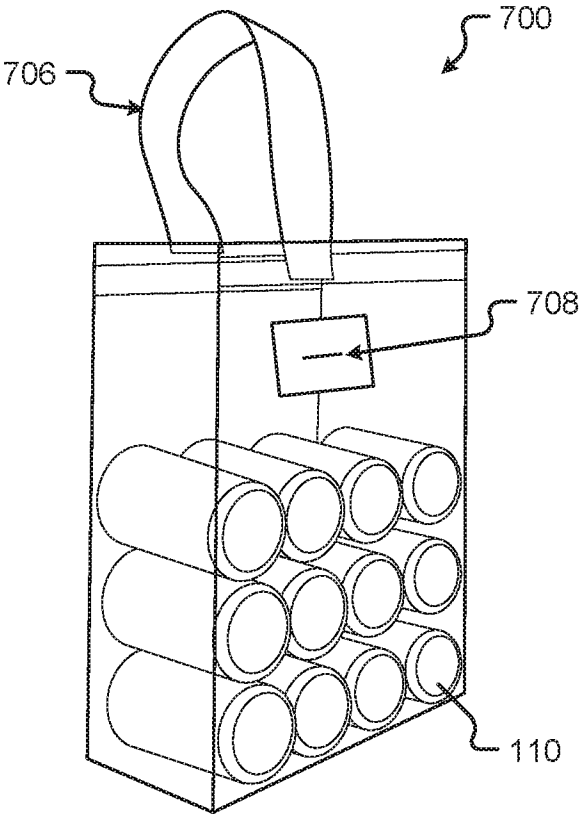
FIG. 7B shows a perspective view of the convertible beverage container package having the integrated cooler compartment of FIG. 7A in an unfolded state.

FIGS. 7A-7C show various perspective views of a convertible beverage container package having an integrated cooler compartment, or package, 700 in accordance with embodiments of the present disclosure. The material, structure, and/or manufacture of the package 700 may be similar, if not identical, to the material, structure, and/or manufacture of the packages 100, 200, 300, 400, 500, 600 described in conjunction with FIGS. 1A-6C, and as such, any description of the same may equally apply to the package 700 of FIGS. 7A-7C, and vice versa.

In some embodiments, the package 700 may include a strap handle 706 that extends from a portion of the package 700 through a slit 708, or hole, disposed in the package 700. This arrangement can allow a user to conveniently carry the package 700 of canned beverages 110 (e.g., from a retail setting to a home setting, etc.). After carrying the package 700 to a destination, the package 700 may be opened and the strap handle 706 may be fed through the slit 708 toward the interior compartment 112 and then pulled from the compartment 112 through the opening end, as shown in FIG. 7B, to an exposed position. Once a portion of the strap handle 706 is removed from the compartment 112, the package 700 can be filled with ice 120 (as described herein), and the package 700 can be transported via the exposed strap handle 706. In some embodiments, the wall of the package 700 including the slit 708 may be reinforced with additional material surrounding the hole 708, folded portions of material, bonded material, and/or some other slit reinforcement feature.

The exemplary devices and systems of this disclosure have been described in relation to canned beverage storage packages. However, to avoid unnecessarily obscuring the present disclosure, the preceding description omits a number of known structures and devices. This omission is not to be construed as a limitation of the scope of the claimed disclosure. Specific details are set forth to provide an understanding of the present disclosure. It should, however, be appreciated that the present disclosure may be practiced in a variety of ways beyond the specific detail set forth herein.

A number of variations and modifications of the disclosure can be used. It would be possible to provide for some features of the disclosure without providing others.

The present disclosure, in various embodiments, configurations, and aspects, includes components, methods, processes, systems and/or apparatus substantially as depicted and described herein, including various embodiments, subcombinations, and subsets thereof. Those of skill in the art will understand how to make and use the systems and methods disclosed herein after understanding the present disclosure. The present disclosure, in various embodiments, configurations, and aspects, includes providing devices and processes in the absence of items not depicted and/or described herein or in various embodiments, configurations, or aspects hereof, including in the absence of such items as may have been used in previous devices or processes, e.g., for improving performance, achieving ease, and/or reducing cost of implementation.

The foregoing discussion of the disclosure has been presented for purposes of illustration and description. The foregoing is not intended to limit the disclosure to the form or forms disclosed herein. In the foregoing Detailed Description for example, various features of the disclosure are grouped together in one or more embodiments, configurations, or aspects for the purpose of streamlining the disclosure. The features of the embodiments, configurations, or aspects of the disclosure may be combined in alternate embodiments, configurations, or aspects other than those discussed above. This method of disclosure is not to be interpreted as reflecting an intention that the claimed disclosure requires more features than are expressly recited in each claim. Rather, as the following claims reflect, inventive aspects lie in less than all features of a single foregoing disclosed embodiment, configuration, or aspect. Thus, the following claims are hereby incorporated into this Detailed Description, with each claim standing on its own as a separate preferred embodiment of the disclosure.

Moreover, though the description of the disclosure has included description of one or more embodiments, configurations, or aspects and certain variations and modifications, other variations, combinations, and modifications are within the scope of the disclosure, e.g., as may be within the skill and knowledge of those in the art, after understanding the present disclosure. It is intended to obtain rights, which include alternative embodiments, configurations, or aspects to the extent permitted, including alternate, interchangeable and/or equivalent structures, functions, ranges, or steps to those claimed, whether or not such alternate, interchangeable and/or equivalent structures, functions, ranges, or steps are disclosed herein, and without intending to publicly dedicate any patentable subject matter.

Embodiments include a beverage package, comprising: a flexible bag, comprising: at least two sides offset from one another and joined together via two or more edges; an interior volume disposed between the at least two sides; an opening at a first end of the at least two sides; and a base formed at a second end of the at least two sides, the second end of the at least two sides opposite the first end; wherein the flexible bag comprises a packaging state and a converted state, the packaging state including a plurality of folds disposed in the at least two sides defining a substantially rectangular cuboid shape of the flexible bag in the packaging state and sized to receive a plurality of canned beverages, the converted state releasing the plurality of folds in the at least two sides and providing access to the interior volume via the opening, the interior volume sized and shaped to receive and direct inserted ice to at least two sides of the plurality of canned beverages.

Aspects of the above beverage package include wherein in the packaging state each of the at least two sides are in contact with the canned beverages, and wherein in the converted state each of the at least two sides are spaced apart from the canned beverages. Aspects of the above beverage package include wherein a cooling volume configured to receive a portion of the inserted ice is disposed in the volume between the at least two sides spaced apart from the canned beverages. Aspects of the above beverage package include wherein the flexible bag is tapered from a first width measured adjacent to the opening and a smaller second width measured adjacent to the base. Aspects of the above beverage package include wherein the flexible bag further comprises: a closure mechanism disposed adjacent to the opening and running from a first of the two or more edges to a second of the two or more edges. Aspects of the above beverage package further comprising: a handle cutout passing through the at least two sides, wherein the closure mechanism is disposed above the handle cutout adjacent to the opening at the first end. Aspects of the above beverage package include wherein the base includes gusseted portions of the at least two sides. Aspects of the above beverage package include wherein the base is a separate piece of material joined to the at least two sides along two or more leak-proof seams. Aspects of the above beverage package include wherein the flexible bag is made from plastic. Aspects of the above beverage package include wherein the flexible bag is recyclable and/or biodegradable. Aspects of the above beverage package include wherein the flexible bag is reusable.

Embodiments include a convertible beverage package, comprising: a flexible bag, comprising: an internal compartment having an opening end and a closed end; a front wall disposed opposite a rear wall, wherein the front wall is joined to the rear wall along a lower edge at the closed end; a first side wall joined to the front wall along a first edge running from the opening end to the closed end, the first side wall joined to the rear wall along a second edge running from the opening end to the closed end; a second side wall disposed opposite the first side wall, the second side wall joined to the front wall along a third edge running from the opening end to the closed end, the second side wall joined to the rear wall along a fourth edge running from the opening end to the closed end; and a base formed at the closed end of the internal compartment, the base formed at least partially via folding the lower edge of the flexible bag against the rear wall and sealing the lower edge to the rear wall; wherein the flexible bag comprises a packaging state and a converted state, the packaging state including a plurality of folds disposed in the front wall, the rear wall, the first side wall, and the second side wall defining a substantially rectangular cuboid shape of the flexible bag in the packaging state and sized to receive a plurality of canned beverages, the converted state releasing the plurality of folds in the front wall, the rear wall, the first side wall, and the second side wall providing access to the internal compartment via the opening end, the internal compartment sized and shaped to receive and direct inserted ice to at least two sides of the plurality of canned beverages.

Aspects of the above convertible beverage package further comprising: a first handle cutout disposed in the front wall of the flexible bag, wherein the first handle cutout provides a first opening to the internal compartment from an outside of the flexible bag. Aspects of the above convertible beverage package further comprising: a second handle cutout disposed in the rear wall of the flexible bag, wherein the first handle cutout provides a second opening to the internal compartment from the outside of the flexible bag, wherein the first handle cutout and the second handle cutout are aligned with one another along at least one centerline. Aspects of the above convertible beverage package further comprising: a re-sealable closure disposed adjacent to an edge of the opening end, the re-sealable closure providing selective access to the internal compartment, wherein the internal compartment is closed at the opening end by pressing the re-sealable closure joining the front wall to the second wall together at the opening end, and wherein internal compartment is opened at the opening end by separating the re-sealable closure moving the front wall from the second wall at the opening end. Aspects of the above convertible beverage package include wherein the re-sealable closure includes a first closure element disposed on an internal surface of the front wall and a second closure element disposed on an internal surface of the second wall, and wherein the first closure element selectively and repeatedly interconnects with the second closure element. Aspects of the above convertible beverage package include wherein the first closure element of the re-sealable closure is disposed above the first handle cutout, and the second closure element of the re-sealable closure is disposed above the second handle cutout. Aspects of the above convertible beverage package include wherein in the packaging state the front wall and the rear wall are in contact with the canned beverages, and wherein in the converted state the front wall and the rear wall are spaced apart from the canned beverages. Aspects of the above convertible beverage package include wherein in the converted state the flexible bag deforms in response to inserting ice into the internal compartment between the canned beverages and at least one of the front wall, the rear wall, the first side wall, and the second side wall. Aspects of the above convertible beverage package include wherein the flexible bag is recyclable and/or biodegradable. Aspects of the above convertible beverage package include wherein the flexible bag is reusable.

Embodiments include a canned beverage package, comprising: a flexible bag, comprising: an internal compartment having an opening end and a closed end; a front wall disposed opposite a rear wall, wherein the front wall is joined to the rear wall along a lower edge at the closed end; a first side wall joined to the front wall along a first edge running from the opening end to the closed end, the first side wall joined to the rear wall along a second edge running from the opening end to the closed end; a second side wall disposed opposite the first side wall, the second side wall joined to the front wall along a third edge running from the opening end to the closed end, the second side wall joined to the rear wall along a fourth edge running from the opening end to the closed end; and a base formed at the closed end of the internal compartment, the base formed at least partially via folding the lower edge of the flexible bag against the rear wall and sealing the lower edge to the rear wall; wherein the flexible bag comprises a packaging state and a converted state, the packaging state including a plurality of folds disposed in the front wall, the rear wall, the first side wall, and the second side wall defining a substantially rectangular cuboid shape of the flexible bag in the packaging state and sized to receive a plurality of canned beverages, the converted state releasing the plurality of folds in the front wall, the rear wall, the first side wall, and the second side wall providing access to the internal compartment via the opening end, the internal compartment sized and shaped to receive and direct inserted ice to at least two sides of the plurality of canned beverages; and a plurality of canned beverages disposed inside the internal compartment of the flexible bag.

Aspects of the above canned beverage package include wherein the plurality of canned beverages are each oriented in an axis-horizontal arrangement in the packaging state such that an axis of each canned beverage in the plurality of the canned beverages runs substantially parallel with the base of the flexible bag. Aspects of the above canned beverage package include wherein the flexible bag is reusable for carrying canned beverages or for other purposes.

Any one or more of the aspects/embodiments as substantially disclosed herein.

Any one or more of the aspects/embodiments as substantially disclosed herein optionally in combination with any one or more other aspects/embodiments as substantially disclosed herein.

One or more means adapted to perform any one or more of the above aspects/embodiments as substantially disclosed herein.

The phrases "at least one," "one or more," "or," and "and/or" are open-ended expressions that are both conjunctive and disjunctive in operation. For example, each of the expressions "at least one of A, B and C," "at least one of A, B, or C," "one or more of A, B, and C," "one or more of A, B, or C," "A, B, and/or C," and "A, B, or C" means A alone, B alone, C alone, A and B together, A and C together, B and C together, or A, B and C together.

The term "a" or "an" entity refers to one or more of that entity. As such, the terms "a" (or "an"), "one or more," and "at least one" can be used interchangeably herein. It is also to be noted that the terms "comprising," "including," and "having" can be used interchangeably.

What is claimed is:

1. A beverage package, comprising:

a flexible bag, comprising:

an internal compartment having an opening end and a closed end;

a front wall disposed opposite a rear wall, wherein the front wall is joined to the rear wall along a lower edge at the closed end;

a first side wall joined to the front wall along a first edge running from the opening end to the closed end, the first side wall joined to the rear wall along a second edge running from the opening end to the closed end;

a second side wall disposed opposite the first side wall, the second side wall joined to the front wall along a third edge running from the opening end to the closed end, the second side wall joined to the rear wall along a fourth edge running from the opening end to the closed end; and a base formed at the closed end of the internal compartment, wherein the base comprises:

a first interior shape seal extending from the second edge toward a center of the flexible bag adjacent the lower edge, wherein the first interior shape seal joins the rear wall to the first side wall along a length of the first interior shape seal;

a second interior shape seal extending from the fourth edge toward the center the flexible bag adjacent the lower edge, wherein the second interior shape seal joins the rear wall to the second side wall along a length of the second interior shape seal; and a third interior shape seal offset a distance from the lower edge and extending from the first interior shape seal to the second interior shape seal, and wherein the third interior shape seal joins the rear wall to the front wall along a length of the third interior shape seal between the first interior shape seal and the second interior shape seal;

wherein the flexible bag comprises a packaging state and a converted state, the packaging state including a folded arrangement of a plurality of folds disposed in the front wall, the rear wall, the first side wall, and the second side wall defining a substantially rectangular cuboid shape of the flexible bag in the packaging state and sized to receive a plurality of canned beverages, the converted state including an unfolded arrangement of the plurality of folds disposed in the front wall, the rear wall, the first side wall, and the second side wall providing access to the internal compartment via the opening end, the internal compartment sized and shaped to receive and direct inserted ice to at least two sides of the plurality of canned beverages.

2. The beverage package of claim 1, wherein, in the converted state, the front wall, the rear wall, the first side wall, and the second side wall are shaped as a funnel running from the opening end to the closed end.

3. The beverage package of claim 1, wherein the flexible bag further comprises:

a closure mechanism disposed adjacent to the opening end and running from the first edge to the third edge.

4. The beverage package of claim 3, further comprising:

a handle cutout passing through the front wall and the rear wall, wherein the closure mechanism is disposed above the handle cutout adjacent to the opening end.

5. The beverage package of claim 3, wherein the base includes gusseted portions disposed in the first side wall and in the second side wall.

6. The beverage package of claim 3, wherein the flexible bag is made from plastic.

7. The beverage package of claim 6, wherein the flexible bag is at least one of recyclable and biodegradable.

8. The beverage package of claim 1, wherein the flexible bag, in the converted state, is tapered from a first width measured between the front wall and the rear wall adjacent the opening end to a smaller second width measured between the front wall and the rear wall adjacent the base.

9. A convertible beverage package, comprising:

a flexible bag, comprising:

an internal compartment having an opening end and a closed end;

a front wall disposed opposite a rear wall, wherein the front wall is joined to the rear wall along a lower edge at the closed end;

a first side wall joined to the front wall along a first edge running from the opening end to the closed end, the first side wall joined to the rear wall along a second edge running from the opening end to the closed end;

a second side wall disposed opposite the first side wall, the second side wall joined to the front wall along a third edge running from the opening end to the closed end, the second side wall joined to the rear wall along a fourth edge running from the opening end to the closed end; and a base formed at the closed end of the internal compartment, wherein the base comprises:

a first interior shape seal extending from the second edge toward a center of the flexible bag adjacent the lower edge, wherein the first interior shape seal joins the rear wall to the first side wall along a length of the first interior shape seal;

a second interior shape seal extending from the fourth edge toward the center the flexible bag adjacent the lower edge, wherein the second interior shape seal joins the rear wall to the second side wall along a length of the second interior shape seal;

a third interior shape seal offset a distance from the lower edge and extending from the first interior shape seal to the second interior shape seal, and wherein the third interior shape seal joins the rear wall to the front wall along a length of the third interior shape seal between the first interior shape seal and the second interior shape seal; and a base fold offset from the lower edge and extending from the second edge to the fourth edge through the first interior shape seal and the second interior shape seal, wherein the base fold separates a bottom portion of the flexible bag from an upper portion of the flexible bag, wherein the bottom portion comprises the lower edge and the third interior shape seal, and wherein a portion of the rear wall of the bottom portion is joined against a portion of the rear wall of the upper portion about the base fold sealing the lower edge to the rear wall along a base material fold seal;

wherein the flexible bag comprises a packaging state and a converted state, the packaging state including a folded arrangement of a plurality of folds disposed in the front wall, the rear wall, the first side wall, and the second side wall defining a substantially rectangular cuboid shape of the flexible bag in the packaging state and sized to receive a plurality of canned beverages, the converted state including an unfolded arrangement of the plurality of folds disposed in the front wall, the rear wall, the first side wall, and the second side wall providing access to the internal compartment via the opening end, the internal compartment sized and shaped to receive and direct inserted ice to at least two sides of the plurality of canned beverages.

10. The convertible beverage package of claim 9, further comprising:

a first handle cutout disposed in the front wall of the flexible bag, wherein the first handle cutout provides a first opening to the internal compartment from an outside of the flexible bag, and wherein the flexible bag is waterproof and capable of holding water in the internal compartment without leaking when in the converted state.

11. The convertible beverage package of claim 10, further comprising:

a second handle cutout disposed in the rear wall of the flexible bag, wherein the second handle cutout provides a second opening to the internal compartment from the outside of the flexible bag, and wherein the first handle cutout and the second handle cutout are aligned with one another along at least one centerline passing through the center of the flexible bag.

12. The convertible beverage package of claim 11, further comprising:

a re-sealable closure disposed adjacent to an edge of the opening end, the re-sealable closure providing selective access to the internal compartment, wherein the internal compartment is closed at the opening end by pressing the re-sealable closure joining the front wall to the rear wall together at the opening end, and wherein the internal compartment is opened at the opening end by separating the re-sealable closure moving the front wall from the rear wall at the opening end.

13. The convertible beverage package of claim 12, wherein the re-sealable closure includes a first closure element disposed on an internal surface of the front wall and a second closure element disposed on an internal surface of the rear wall, and wherein the first closure element selectively and repeatedly interconnects with the second closure element.

14. The convertible beverage package of claim 13, wherein the first closure element of the re-sealable closure is disposed above the first handle cutout, and the second closure element of the re-sealable closure is disposed above the second handle cutout.

15. The convertible beverage package of claim 14, wherein in the converted state the flexible bag deforms in response to inserting ice into the internal compartment between the plurality of canned beverages and at least one of the front wall, the rear wall, the first side wall, and the second side wall.

16. The convertible beverage package of claim 14, wherein the first closure element of the re-sealable closure extends from the first edge to the third edge, and wherein the second closure element of the re-sealable closure extends from the second edge to the fourth edge.

17. A canned beverage package, comprising:

a plurality of canned beverages; and a flexible bag, comprising:

an internal compartment having an opening end and a closed end;

a front wall disposed opposite a rear wall, wherein the front wall is joined to the rear wall along a lower edge at the closed end;

a first side wall joined to the front wall along a first edge running from the opening end to the closed end, the first side wall joined to the rear wall along a second edge running from the opening end to the closed end;

a second side wall disposed opposite the first side wall, the second side wall joined to the front wall along a third edge running from the opening end to the closed end, the second side wall joined to the rear wall along a fourth edge running from the opening end to the closed end; and a base formed at the closed end of the internal compartment, the base formed at least partially via folding the lower edge of the flexible bag against the rear wall and sealing the lower edge to the rear wall, wherein the base comprises:

a first interior shape seal extending from the second edge toward a center of the flexible bag adjacent the lower edge, wherein the first interior shape seal joins the rear wall to the first side wall along a length of the first interior shape seal;

a second interior shape seal extending from the fourth edge toward the center the flexible bag adjacent the lower edge, wherein the second interior shape seal joins the rear wall to the second side wall along a length of the second interior shape seal; and a third interior shape seal offset a distance from the lower edge and extending from the first interior shape seal to the second interior shape seal, and wherein the third interior shape seal joins the rear wall to the front wall along a length of the third interior shape seal between the first interior shape seal and the second interior shape seal;

wherein the flexible bag comprises a packaging state and a converted state, the packaging state including a folded arrangement of a plurality of folds disposed in the front wall, the rear wall, the first side wall, and the second side wall defining a substantially rectangular cuboid shape of the flexible bag in the packaging state and sized to receive the plurality of canned beverages, the converted state including an unfolded arrangement of the plurality of folds disposed in the front wall, the rear wall, the first side wall, and the second side wall providing access to the internal compartment via the opening end, the internal compartment sized and shaped to receive and direct inserted ice to at least two sides of the plurality of canned beverages, and wherein the plurality of canned beverages are disposed inside the internal compartment of the flexible bag.

18. The canned beverage package of claim 17, wherein the plurality of canned beverages are each oriented in an axis-horizontal arrangement in the packaging state such that an axis of each canned beverage in the plurality of the canned beverages runs substantially parallel with the base of the flexible bag.

19. The canned beverage package of claim 17, wherein the flexible bag is made from plastic.

20. The canned beverage package of claim 17, wherein the flexible bag is at least one of recyclable and biodegradable.

* * * * *